US010947683B2

(12) United States Patent
Shindo et al.

(10) Patent No.: US 10,947,683 B2
(45) Date of Patent: Mar. 16, 2021

(54) STRUCTURE OF SIGN POLE AND SIGN POLE

(71) Applicant: KANAGAWA GIKEN LTD., Kamakura (JP)

(72) Inventors: Tomonori Shindo, Yokohama (JP); Kazumi Matsui, Tokyo (JP)

(73) Assignee: KANAGAWA GIKEN LTD.

( * ) Notice: Subject to any disclaimer, the term of this patent is extended or adjusted under 35 U.S.C. 154(b) by 0 days.

(21) Appl. No.: 16/618,087

(22) PCT Filed: Aug. 13, 2018

(86) PCT No.: PCT/JP2018/030203

§ 371 (c)(1),
(2) Date: Nov. 27, 2019

(87) PCT Pub. No.: WO2019/044477

PCT Pub. Date: Mar. 7, 2019

(65) Prior Publication Data

US 2020/0248416 A1 Aug. 6, 2020

(30) Foreign Application Priority Data

Aug. 28, 2017 (JP) ..... JP2017-163085

(51) Int. Cl.
*E01F 9/623* (2016.01)
*E01F 9/673* (2016.01)
*E04H 12/08* (2006.01)

(52) U.S. Cl.
CPC ..... *E01F 9/623* (2016.02); *E01F 9/673* (2016.02); *E04H 12/085* (2013.01)

(58) Field of Classification Search
CPC ..... E01F 9/623; E01F 9/673; E04H 12/085; G09F 2013/0495; G09F 19/228
See application file for complete search history.

(56) References Cited

U.S. PATENT DOCUMENTS 4,843,746 A * 7/1989 DesNoyers ..... G09F 7/18 40/607.04
2003/0014555 A1 8/2003 Young
(Continued)

FOREIGN PATENT DOCUMENTS

JP 2001-43704 A 2/2001
JP 2001-49899 A 2/2001
JP 2005-188279 A 7/2005

OTHER PUBLICATIONS

International Search Report dated Nov. 20, 2018.

*Primary Examiner* — Gary C Hoge
(74) *Attorney, Agent, or Firm* — Fresh IP PLC; Clifford D. Hyra; Aubrey Y. Chen

(57) ABSTRACT

A structure of a sign pole is provided. The sign pole includes a tubular member that has a predetermined outer diameter, a predetermined inner diameter, and a predetermined thickness. In a state in which the sign pole is embedded in a ground, the sign pole includes a reinforcement portion having a thickness different from the predetermined thickness while maintaining the predetermined outer diameter in a first range from a first position equal to or lower than a level of a ground surface to a second position located a predetermined distance above the level of the ground surface. The reinforcement portion has a thickness larger than the predetermined thickness.

15 Claims, 18 Drawing Sheets

(56) References Cited

U.S. PATENT DOCUMENTS

| | | | | |
|---|---|---|---|---|
| 2009/0142178 | A1* | 6/2009 | Nieuwenhuizen | F03D 13/20 415/2.1 |
| 2010/0325986 | A1* | 12/2010 | Garc a Maestre | E04H 12/085 52/223.3 |
| 2011/0041438 | A1* | 2/2011 | Frost | E02D 27/42 52/296 |
| 2011/0138729 | A1* | 6/2011 | Shiraishi | E04H 12/085 52/651.01 |
| 2011/0232071 | A1* | 9/2011 | Knoop | F03D 80/00 29/525.02 |
| 2015/0159635 | A1* | 6/2015 | Hayden | E04H 12/08 290/55 |

* cited by examiner

FIG. 5

| OUTER DIAMETER D (mm) | INNER DIAMETER d (mm) | THICKNESS t (mm) | SOLID CROSS-SECTION SECONDARY MOMENT If ($mm^4$) | CROSS-SECTION SECONDARY MOMENT I ($mm^4$) | HOLLOW/SOLID RATIO R |
|---|---|---|---|---|---|
| 60.5 | 55.9 | 2.3 | 657311.4124 | 178243.6958 | 0.271170852 |
| 60.5 | 54.9 | 2.8 | 657311.4124 | 211615.0887 | 0.321940384 |
| 60.5 | 54.1 | 3.2 | 657311.4124 | 237031.4019 | 0.360607465 |
| 60.5 | 52.9 | 3.8 | 657311.4124 | 273098.1409 | 0.415477559 |
| 60.5 | 50.5 | 5 | 657311.4124 | 338219.9484 | 0.514550549 |
| 60.5 | 48.5 | 6 | 657311.4124 | 385844.6719 | 0.58700437 |
| 60.5 | 46.5 | 7 | 657311.4124 | 427928.2766 | 0.651028217 |
| 60.5 | 44.5 | 8 | 657311.4124 | 464918.2125 | 0.707302815 |
| 60.5 | 42.5 | 9 | 657311.4124 | 497243.0897 | 0.756480232 |
| 60.5 | 40.5 | 10 | 657311.4124 | 525312.6781 | 0.79918387 |
| 60.5 | 38.5 | 11 | 657311.4124 | 549517.9078 | 0.836008469 |
| 60.5 | 36.5 | 12 | 657311.4124 | 570230.8688 | 0.86752011 |
| 60.5 | 34.5 | 13 | 657311.4124 | 587804.8109 | 0.894256208 |
| 60.5 | 32.5 | 14 | 657311.4124 | 602574.1444 | 0.916725517 |
| 60.5 | 30.5 | 15 | 657311.4124 | 614854.4391 | 0.93540813 |
| 60.5 | 28.5 | 16 | 657311.4124 | 624942.425 | 0.950755476 |
| 60.5 | 26.5 | 17 | 657311.4124 | 633115.9922 | 0.963190324 |
| 60.5 | 24.5 | 18 | 657311.4124 | 639634.1906 | 0.973106778 |
| 60.5 | 22.5 | 19 | 657311.4124 | 644737.2303 | 0.980870282 |
| 60.5 | 20.5 | 20 | 657311.4124 | 648646.4813 | 0.986817616 |
| 60.5 | 18.5 | 21 | 657311.4124 | 651564.4734 | 0.991256901 |
| 60.5 | 16.5 | 22 | 657311.4124 | 653674.8969 | 0.994467591 |
| 60.5 | 14.5 | 23 | 657311.4124 | 655142.6016 | 0.996700482 |
| 60.5 | 12.5 | 24 | 657311.4124 | 656113.5975 | 0.998177706 |
| 60.5 | 10.5 | 25 | 657311.4124 | 656715.0547 | 0.999092732 |
| 60.5 | 8.5 | 26 | 657311.4124 | 657055.3031 | 0.999610368 |
| 60.5 | 6.5 | 27 | 657311.4124 | 657223.8328 | 0.999866761 |
| 60.5 | 4.5 | 28 | 657311.4124 | 657291.2938 | 0.999969392 |
| 60.5 | 2.5 | 29 | 657311.4124 | 657309.4959 | 0.999997084 |
| 60.5 | 0.5 | 30 | 657311.4124 | 657311.4094 | 0.999999995 |
| 60.5 | 0 | 30.25 | 657311.4124 | 657311.4124 | 1 |

STRUCTURE OF SIGN POLE AND SIGN POLE

This application is a National Phase entry of International Application No. PCT/JP2018/030203 under § 371 and claims the benefit of Japanese patent application No. 2017-163085 filed Aug. 28, 2017, which are hereby incorporated by reference in their entirety.

TECHNICAL FIELD

The present invention relates to a structure of a sign pole and a sign pole installed on a road or the like.

BACKGROUND ART

Currently, there are many sign poles on the side of a road. A road sign or mirror is attached to the sign pole. Such sign poles contribute to traffic of cars and pedestrians. In general, the sign poles are embedded in the ground in an upright state. However, these sign poles are bent due to a collision with an automobile or the like in many cases.

In this case, local buckling often occurs at the base and repair work is performed using a sign raising machine or the like. However, when the sign pole is raised by the sign raising machine, the sign pole may be cracked. Then, when the sign pole is bent and removed and a new sign pole or mirror installation pillar is installed again in order to remove risk, it costs a lot of money.

As a measure for preventing local buckling, for example, one disclosed in JP2017-36631A is known. According to JP2017-36631A, a sign pole buckling prevention tool prevents the local buckling of the sign pole at a position located slightly above the ground and it becomes possible to make the sign pole bent gently even by collision with an automobile.

SUMMARY OF THE INVENTION

Problem to be Solved by the Invention

However, the sign pole buckling prevention tool disclosed in JP2017-36631A is disposed at the outside of the outer periphery of the sign pole in the vicinity of the ground. Accordingly, the outer diameter shape of the sign pole near the ground appears to increase in diameter. Since there is a limitation in the embedding space in accordance with the place of installation, it is difficult to increase the outer diameter of the sign pole. When a car or pedestrian passes near the sign pole, the car or pedestrian may step on the sign pole buckling prevention tool. When the sign pole is bent, repair work to recover the bending of the sign pole is performed using a sign raising machine. At this time, there is a possibility that the sign pole buckling prevention tool arranged on the outer periphery of the sign pole may interfere with the work.

Means for Solving the Problem

In order to solve the above-described problems, the invention has the following configuration.

A structure of a sign pole used in a state embedded in a ground according to an embodiment of the invention, includes a sign pole which is formed by a tubular member having a first outer diameter, a first inner diameter, and a first thickness, the first outer diameter having a substantially constant value. In a state in which the sign pole is embedded in the ground, the sign pole includes a first thick portion having a second thickness larger than the first thickness while maintaining the first outer diameter in a first range from a first position equal to or lower than a level of a ground surface to a second position located a predetermined distance above the level of the ground surface. In addition, the sign pole includes a portion that has a thickness gradually decreasing in an upward direction from a thickness of the second position to the first thickness in a position above the second position.

Further objects and other features of the invention will become apparent from the preferred embodiments described below with reference to the accompanying drawings.

BRIEF DESCRIPTION OF THE DRAWINGS

FIG. 5 is a table showing a simulation calculation result of a cross-sectional secondary moment of the sign pole;

DESCRIPTION OF THE EMBODIMENTS

Embodiment 1

Hereinafter, Embodiment 1 of the invention will be described with reference to the drawings.

Description of Sign Pole

Figure 1:
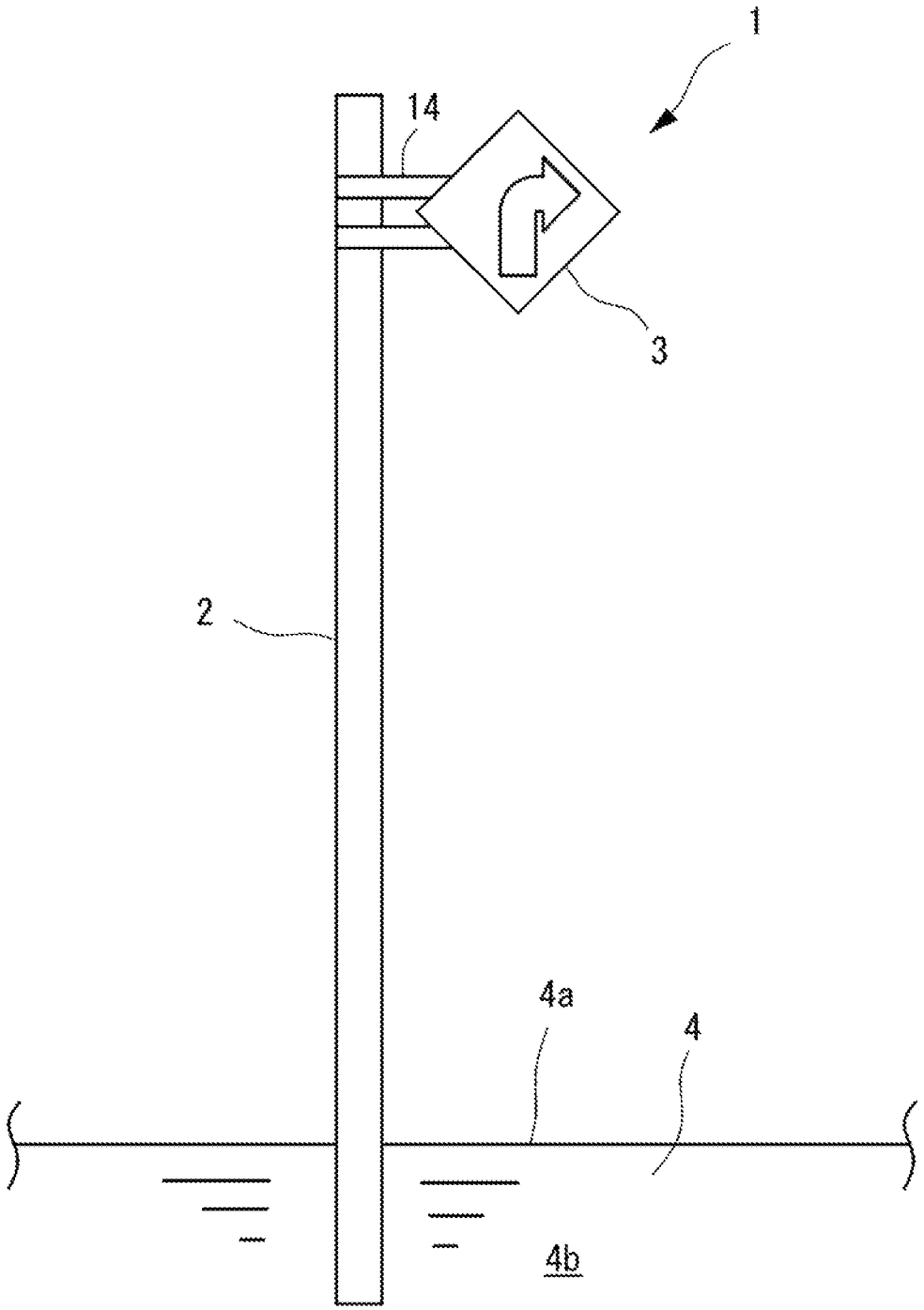
FIG. 1 is an overall view of a road sign using a sign pole according to Embodiment 1.

FIG. 1 is an overall view of a road sign 1 according to Embodiment 1 of the invention. The road sign 1 substantially includes a sign pole 2 and a sign board 3. The sign board 3 is a plate-shaped member fixed to the vicinity of the upper end portion of the sign pole 2 and is generally made of a metal plate of steel or aluminum, and the like. Symbols, characters, and the like are formed on at least one surface (one side surface) of the sign board 3 as sign information. Accordingly, it is possible to exhibit a function of giving information to or alerting a pedestrian or car (hereinafter collectively referred to as a passerby) passing through the vicinity. As an example of the sign information, for example, sign figures such as speed limit, temporary stop, and parking prohibition can be listed.

The sign pole 2 has a function of posting the sign board 3 at a predetermined height so that the sign board 3 can be easily recognized by the passerby or the like. The sign pole 2 is generally formed by a metal circular tube of steel or the like. For example, a steel pipe having an outer diameter of about 60 mm to 80 mm and a thickness of about 2 mm to 4 mm is used as the sign pole 2. There are various lengths of the sign pole 2 and, for example, a length of about 2 to 5 m is often used. The sign board 3 is attached to the vicinity of the upper end of the sign pole 2 via a fixing bracket 14 such that the passerby or the like can see easily from a distance. The lower portion of the sign pole 2 is embedded in a ground 4. Then, the sign pole 2 is installed so as to be erected from a ground surface 4*a*.

Figure 2A:
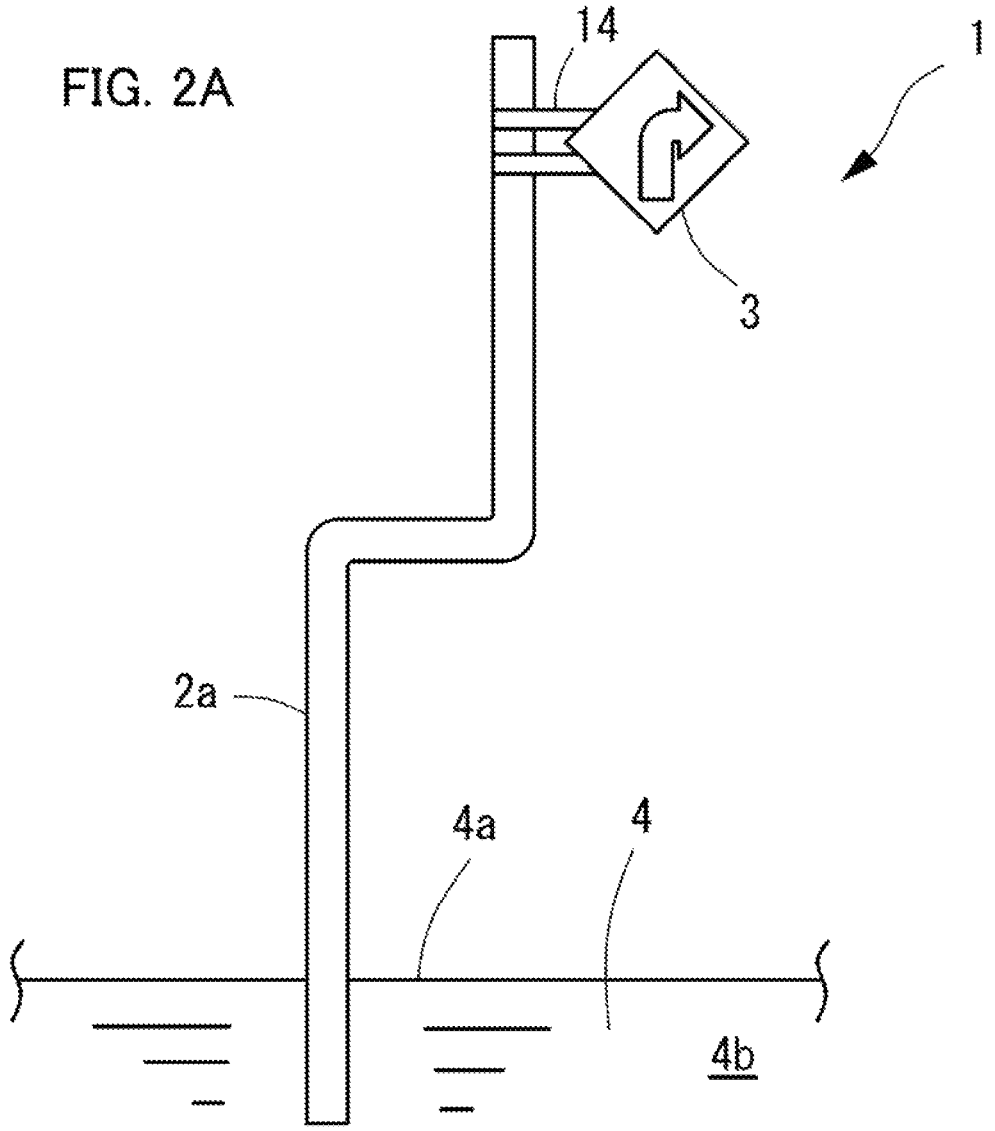
FIGS. 2(*a*) and 2(*b*) are diagrams illustrating another example of the sign pole.
Figure 2B:
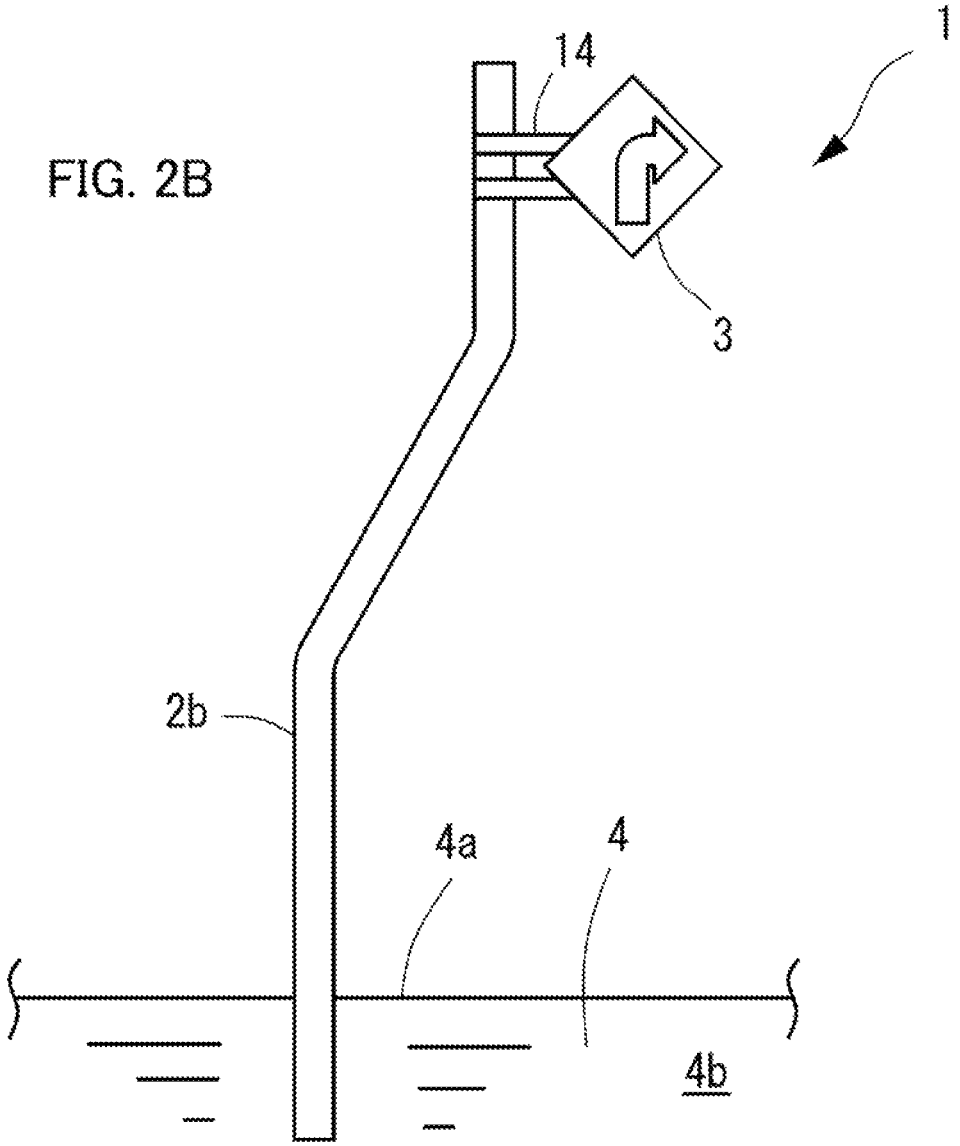

The sign pole 2 is not necessarily limited to a linear steel pipe. For example, the sign pole can be partially bent in response to the installation position as a sign pole 2*a* illustrated in FIG. 2(*a*) or a sign pole 2*b* illustrated in FIG. 2(*b*). However, many sign poles (2, 2*a*, and 2*b*) have a substantially linear shape in a portion embedded in the ground 4.

Internal Structure of Sign Pole

Figure 3:
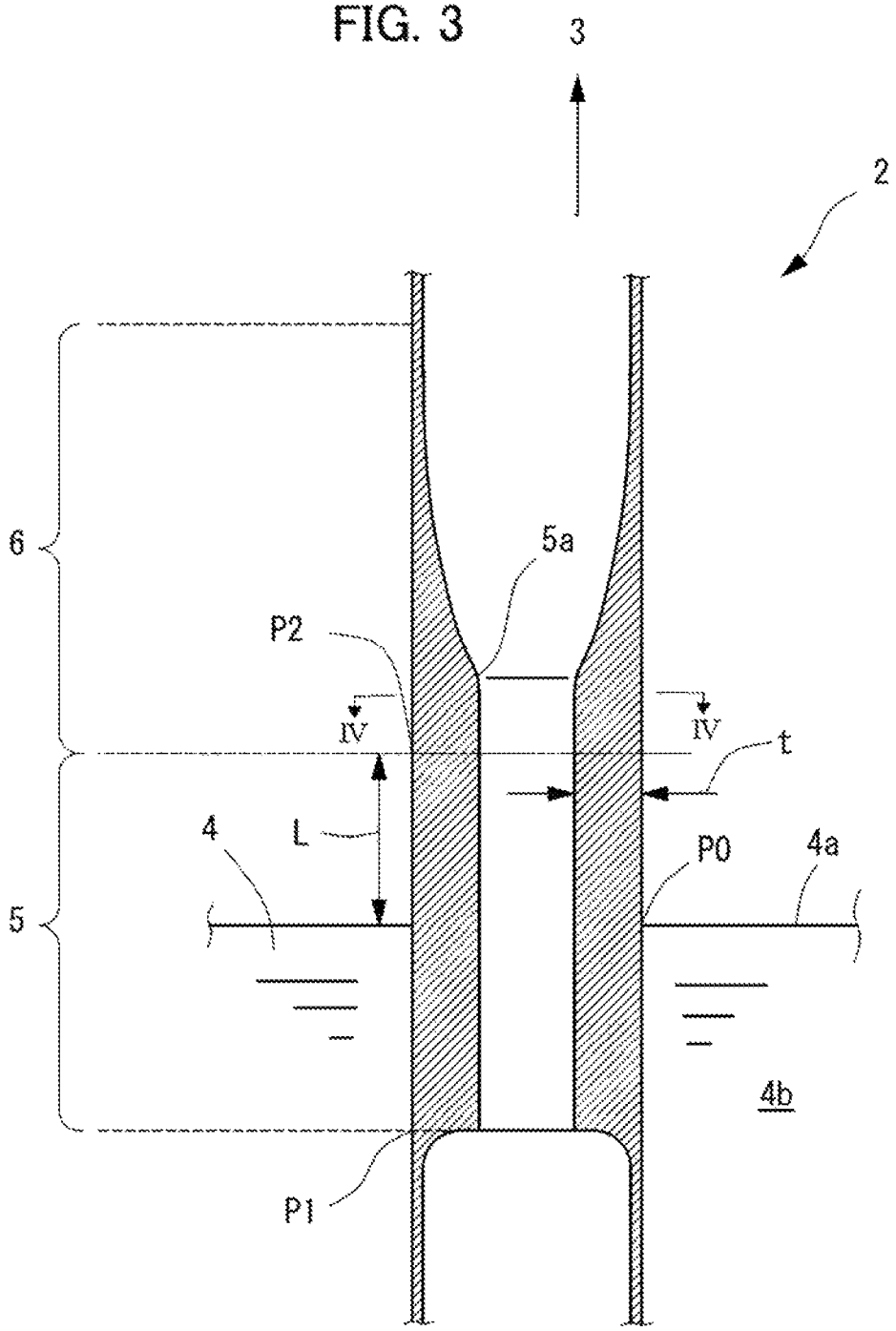
FIG. 3 is a cross-sectional view illustrating an internal structure of the sign pole according to Embodiment 1.

FIG. 3 is a cross-sectional view illustrating an internal structure of the sign pole 2 according to Embodiment 1. Additionally, FIG. 3 is a cross-sectional view taken along the extension direction of the sign pole 2. Similarly, the cross-sectional views shown below represent cross-sectional views of the sign pole in the extension direction unless otherwise specified. FIG. 3 illustrates the vicinity of a position corresponding to a level of the ground surface 4*a* when the sign pole 2 is installed on the ground 4. In the sign pole 2, a lower portion of the sign pole 2 is embedded in an underground 4*b*. Further, most part of the sign pole 2 is disposed so as to be erected on the ground surface 4*a*. Additionally, a height position corresponding to the level of the ground surface 4*a* of the sign pole 2 is defined as a position P0. Further, when viewed from the position P0, the underground side will be referred to as the lower side and the ground side (the side of the sign board 3) will be referred to as the upper side.

The sign pole 2 has an outer diameter (a first outer diameter) with a constant value and an inner diameter (a first inner diameter) with a constant value in a portion other than a first range (to be described later) corresponding to a range including the position P0. That is, the sign pole 2 is formed by a circular tubular member having a constant thickness (a thickness t1) in a portion other than the first range. For example, in Embodiment 1, the sign pole 2 is made of a steel pipe having an outer diameter of 60.5 mm and a thickness of 2.8 mm in a portion other than the first range. Of course, the sign pole 2 may be a tubular member and is not limited to a circular tube. In some cases, the invention can be applied to a sign pole formed by a polygonal tubular member such as a triangular tubular member having a triangular cross section and a square tubular member having a square cross section, an oval tubular member having an oval cross section, or the like.

The first range is a range which has a thickness (hereinafter, referred to as a thickness t2) different from a predetermined thickness (t1) and in which the strength of the sign pole 2 is improved. For example, as illustrated in FIG. 3, the first range is from a first position P1 below the ground surface 4*a* to a second position P2 located above the ground surface 4*a* by a predetermined distance L. A portion of the sign pole 2 corresponding to the first range will be referred to as a reinforcement portion (a first thick portion) 5. The thickness of the reinforcement portion 5 is larger than the thickness of the other portion of the sign pole 2.

In FIG. 3, the thickness of the sign pole 2 at the first position P1 changes from 2.8 mm to 17.7 mm. That is, the inner diameter of the sign pole 2 at the first position P1 changes from 54.9 mm to 25.1 mm. The predetermined distance L is, for example, 10 mm. That is, the second position P2 is, for example, a position separated upward by 10 mm from the position P0. The predetermined distance L may be 0 mm or more and is preferably 5 mm or more. Further, the predetermined distance L is more preferably 10 mm or more.

In general, when an automobile or the like collides with a sign pole (to which the invention is not applied) so that a large external force (bending moment force) is applied from the outside, the sign pole is buckled and bent at a position located above the ground surface by approximately 10 mm in many cases. For that reason, it is preferable to increase the thickness at a position located above the ground surface by approximately 10 mm so as to prevent buckling and make the sign pole bend gently without breaking the sign pole. In a case where the sign pole is gently bent, the sign pole can be relatively easily restored to the original upright state by a sign raising machine or the like.

Further, in a case where a sign pole (which the invention is not applied) is locally buckled at a position located above the ground surface by approximately 10 mm, the sign pole may have wrinkles along the lateral direction (horizontal direction). The wrinkles are caused by the depression of the sign pole in the internal direction (the direction of the center of the circular cross section). However, when the thickness of the sign pole is increased at a position located above the ground surface by approximately 10 mm or another reinforcement member is provided inside the sign pole, the sign pole becomes difficult to be recessed inwardly. As a result, local buckling is less likely to occur at this position. Next, the upper limit value of the predetermined distance L can be obtained as follows. Lmax is defined as a predetermined distance L at which a sign pole is not buckled and bent even when an automobile collides with a sign pole (which the invention is not applied) so that a large external force (bending moment force) is applied from the outside. By the famous Euler's formula for the elastic buckling of the long post, the upper limit Lmax of the predetermined distance is expressed by the following equation. Here, the upper limit Lmax of the predetermined distance can be defined as the length of the compression field that causes buckling deformation simultaneously with the elastic limit (yield).

$$L_{max} \geq \frac{t}{\beta}\sqrt{\frac{\pi^2 E}{12\sigma_Y}}$$

Here, the parameters t, β, E, and $\sigma_Y$ are defined as below.

Lmax: Upper-limit value of predetermined distance t: Thickness

β: Effective buckling length (0.7 for a case in which a lower end is completely fixed and an upper end is pin supported)

E: Young's modulus $\sigma_Y$: Yield stress

Here, it should be noted that Lmax depends on the thickness t of the sign pole and does not depend on the outer diameter of the sign pole. Thus, it is understood that the local buckling accompanied by plastic deformation can be substantially prevented by increasing the thickness at the position up to Lmax from the ground surface in the sign pole. Furthermore, the weight of the sign pole can be decreased by setting a range having the large thickness of the sign pole up to Lmax from the ground surface.

For example, when the sign pole is made of steel, a typical Young's modulus is about 200 GPa. Assuming that the yield stress is 180 MPa, Lmax with respect to the thickness t of the sign pole can be obtained as below. When the thickness t is 2.3 mm, Lmax is 99.3 mm. When the thickness t is 2.8 mm, Lmax is 120.9 mm. When the thickness t is 3.2 mm, Lmax is 138.2 mm.

It is preferable that the thick portion of the sign pole 2 from the first position P1 to the second position P2 is the same thickness. Further, it is preferable that the thick portion of the sign pole 2 from the first position P1 to the second position P2 is the maximum thickness in the thickness of the sign pole 2. Particularly, it is preferable that the thickness of the sign pole 2 at the second position P2 is the maximum thickness. However, the invention is not necessarily limited thereto. It is possible to make the thickness of the reinforcement portion 5 change to a certain degree or partially different. Although it is not always necessary to have the maximum thickness, it is necessary that the thickness is larger than a portion other than the reinforcement portion 5 and the strength is high.

The thickness of the sign pole 2 above the second position P2 may gradually decrease upward. For example, as illustrated in FIG. 3, the thickness may decrease in a curvilinear shape (for example, a parabolic shape) in the cross section. In this case, the inner surface of the sign pole 2 has a mortar-like shape. Further, the thickness may linearly decrease. In this case, the inner surface of the sign pole 2 has a conical shape. Finally, the thickness of the sign pole 2 at a position above the second position P2 becomes 2.8 mm which is the same as the predetermined thickness (t1).

The outer diameter of the sign pole 2 is constant at a position in the vicinity of the ground surface 4*a* including the reinforcement portion 5 so that a simple cylindrical shape is formed in appearance. Thus, no extra space is required at the installation position of the sign pole 2. The installation position can be selected with a high degree of freedom in the same way as a general sign pole. Further, even after the sign pole 2 is installed, no member disturbing the passage exists in the vicinity when the passerby or the like passes by the vicinity of the sign pole 2. Thus, the passability of the passerby or the like can be improved.

Meanwhile, the reinforcement portion 5 exists in the vicinity of the level of the ground surface 4*a* in the sign pole 2. Accordingly, the sign pole 2 has high strength in the vicinity of the ground surface 4*a*. As a result, the sign pole 2 is not easily bent or damaged even by a collision with an automobile or the like. The sign pole 2 is prevented from being damaged and is difficult to be bent. Even when the sign pole 2 is bent, the sign pole is gently bent.

Additionally, in the description above, a case in which the outer diameter of the sign pole 2 is 60.5 mm, the predetermined thickness is 2.8 mm, the thickness of the reinforcement portion 5 is 17.7 mm, and the second position P2 is a position separated upward from the position P0 by 10 mm (the predetermined distance L is 10 mm) has been described. These numerical values are examples of the sign pole 2 of the invention and the gist of the invention is not necessarily limited to the numerical values described herein. For example, when the predetermined thickness is 2.8 mm, the thickness of the reinforcement portion 5 is preferably 17.7 mm or more and further preferably 20 mm or more. However, even when the thickness of the reinforcement portion 5 is 5 mm or more or 10 mm or more, a certain strength improvement effect is exhibited although not large as 17.7 mm.

Further, stress concentration generated when an automobile or the like collides with the sign pole 2 or stress concentration generated in repair work of fixing the curve of the bent sign pole 2 generally occurs at a position located above by approximately 10 mm from the ground surface 4*a*. For that reason, it is preferable to set the second position P2 to a position located above by 10 mm or more from the position P0. Of course, it is more preferable to set the second position P2 to a larger value from the position P0, for example, a position located above by 20 mm.

In Embodiment 1, the reinforcement portion 5 and a portion (hereinafter, referred to as a decreasing portion 6) located thereabove such that the thickness gradually decreases are integrally formed with the other portion of the sign pole 2. That is, the overall sign pole 2 including the reinforcement portion 5 and the decreasing portion 6 is formed as one piece. For example, the reinforcement portion 5 and the decreasing portion 6 can be formed by cutting an inner surface of a cylindrical steel material with an outer diameter of 60.5 mm using a gun drill or a boring bar.

Further, the reinforcement portion 5 and the decreasing portion 6 are smoothly connected so that an inflection point is not formed at a connection point 5*a*. That is, the connection point 5*a* between the reinforcement portion 5 and the decreasing portion 6 is rounded. By the rounded finishing, the concentration of stress on the connection point 5*a* is prevented. As a result, for example, the durability of the sign pole 2 against fatigue caused by repeated bending and the resistance to a large impact are improved.

Figure 4A:
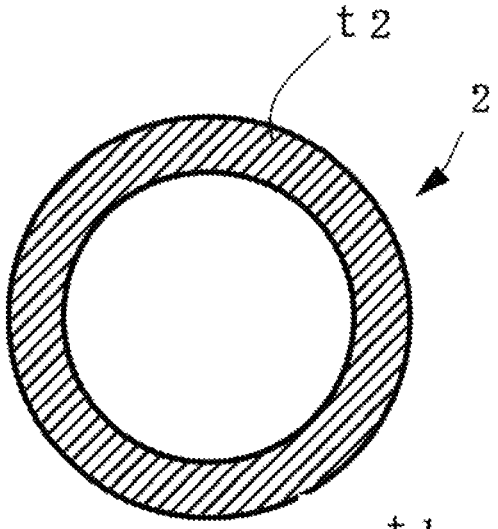
FIG. 4(*a*) is a cross-sectional view taken along the line IV-IV of the sign pole 2 illustrated in FIG. 3, FIG. 4(*b*) is a cross-sectional view taken along the line IV-IV of the sign pole 2 illustrated in FIG. 3, and FIG. 4(*c*) is a cross-sectional view taken along the line IV-IV of the sign pole 2 illustrated in FIG. 3.
Figure 4B:
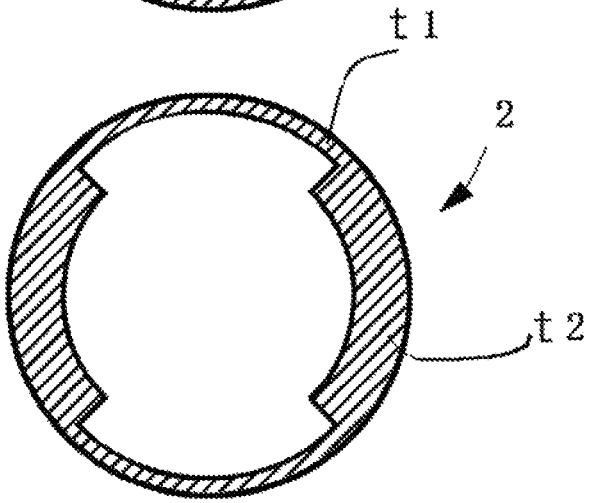
Figure 4C:
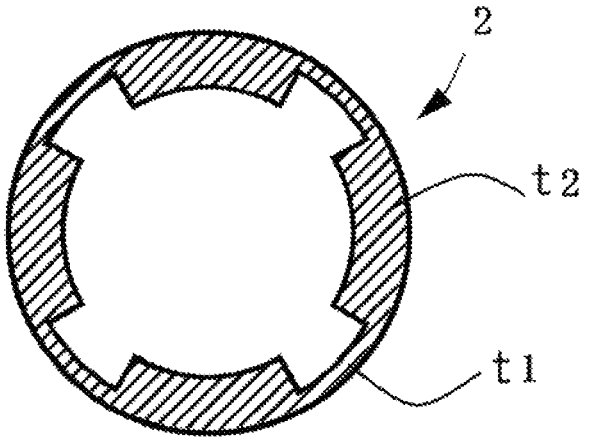

FIG. 4 is a cross-sectional view taken along the line IV-IV of the sign pole 2 illustrated in FIG. 3. FIG. 4(*a*) illustrates a case in which the thickness t2 is substantially the same thickness along the outer circumference of the sign pole 2. FIGS. 4(*b*) and 4(*c*) illustrate cases in which the thickness is partially different along the outer circumference of the sign pole 2. Specifically, FIG. 4(*b*) illustrates a case in which two opposite positions of the circumference are thick. A thick portion b2 has a thickness t2 and a thin portion b1 has a thickness t1. Similarly, FIG. 4(*c*) illustrates a case in which four opposite positions of the circumference are thick. A thick portion c2 has a thickness t2 and a thin portion c1 has a thickness t1. In the embodiment, since the sign pole 2 is gently bent in the vicinity of the thin portion when a large external force (bending moment force) is applied thereto due to a collision with an automobile or the like, the bending direction can be controlled to a constant direction. Additionally, the thick positions may not be provided at the opposite positions and may be provided in a part of the circumference.

Simulation Calculation of Cross-Sectional Secondary Moment

Here, in order to examine to what degree the thickness of the reinforcement portion 5 of the sign pole 2 should be set to obtain sufficient reinforcement effect, a simulation calculation result for strength (bending rigidity) is shown below. The strength of the circular pipe member can be evaluated by the value of the cross-sectional secondary moment. The cross-sectional secondary moment of the sign pole 2 of Embodiment 1 as the circular pipe member is given by the following equation (1).

$$I=\pi(D^4-d^4)/64 \quad \text{(Equation (1))}$$

Here,

I: Cross-sectional secondary moment of sign pole 2

D: Outer diameter of sign pole 2 d: Inner diameter of sign pole 2

FIG. 5 is a table showing a calculation result of the cross-sectional secondary moment when the outer diameter D of the sign pole 2 is 60.5 mm and the inner diameter d changes from 2.3 mm to 30.25 mm. In the table of FIG. 5, the thickness t of the sign pole 2 (=(D−d)/2), the solid cross-sectional secondary moment If when the sign pole 2 is not a hollow circular tube but a solid column, and the ratio (the hollow/solid ratio R=I/If) between I and If are also described. Additionally, a case in which the inner diameter of the sign pole 2 is 30.25 mm substantially corresponds to a case in which the sign pole 2 is not a circular tube (hollow member) but a column (solid member).

As understood from the table of FIG. 5, the value of the cross-sectional secondary moment I increases as the thickness t of the sign pole 2 increases, and thus strength (bending rigidity) increases. A relationship of the value of the ratio between the thickness t and the outer diameter D (the thickness/outer diameter ratio=t/D) and the hollow/solid ratio R is as follows.

R=0.515 in the case of thickness t=5 mm (t/D=0.0826)

R=0.799 in the case of thickness t=10 mm (t/D=0.165)

R=0.963 in the case of thickness t=17 mm (t/D=0.281)

R=0.987 in the case of thickness t=20 mm (t/D=0.331)

That is, when the thickness/outer diameter ratio is 0.281 or more (t≥17 mm), the hollow/solid ratio R exceeds 95%. In this case, it can be said that the bending rigidity of the circular pipe member is not much different from the bending rigidity of the solid columnar member.

Embodiment 2

Figure 6A:
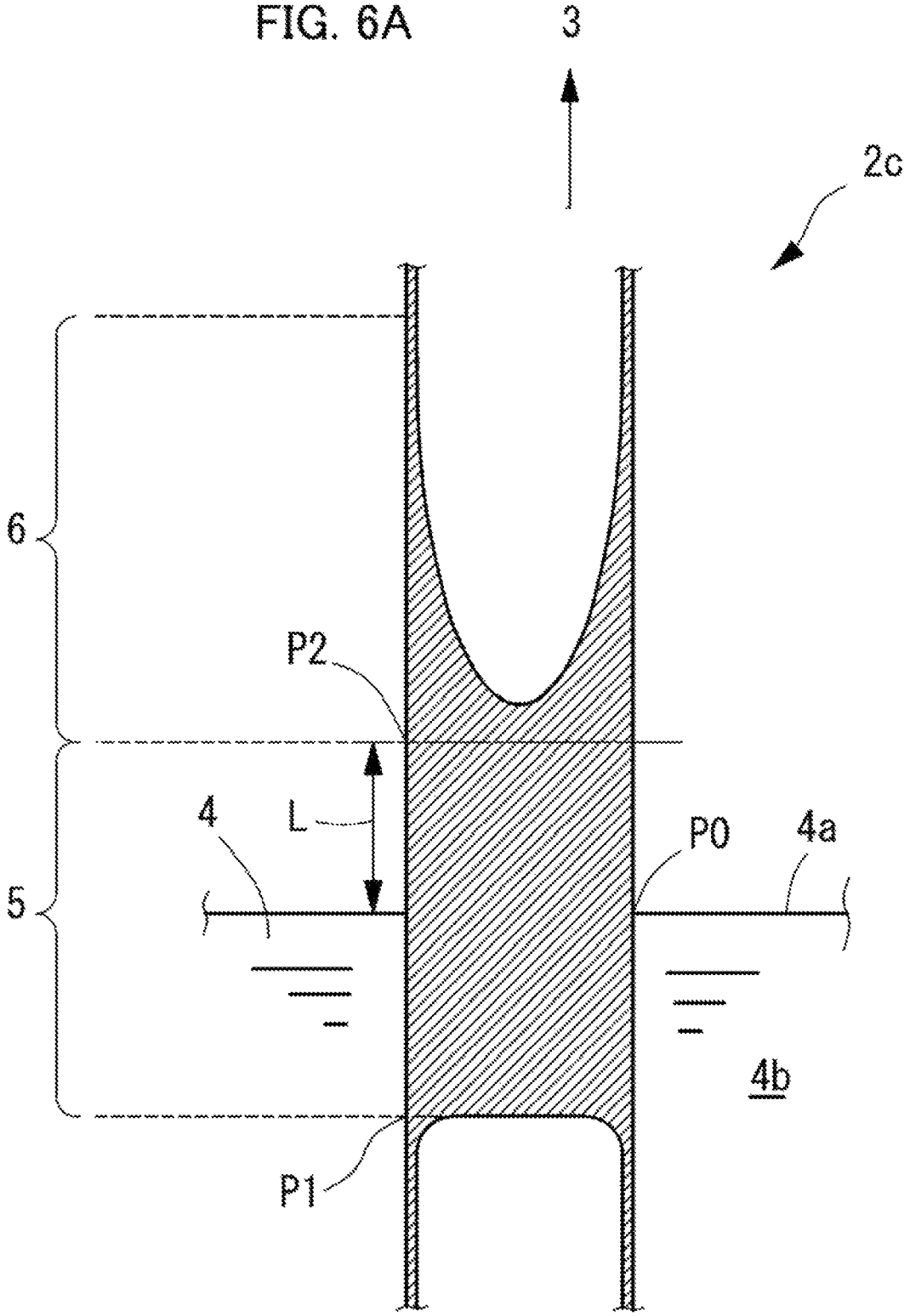
FIG. 6(*a*) is a cross-sectional view illustrating an internal structure of a sign pole according to Embodiment 2 and FIG. 6(*b*) is a cross-sectional view illustrating an internal structure of a sign pole according to Embodiment 3.
Figure 6B:
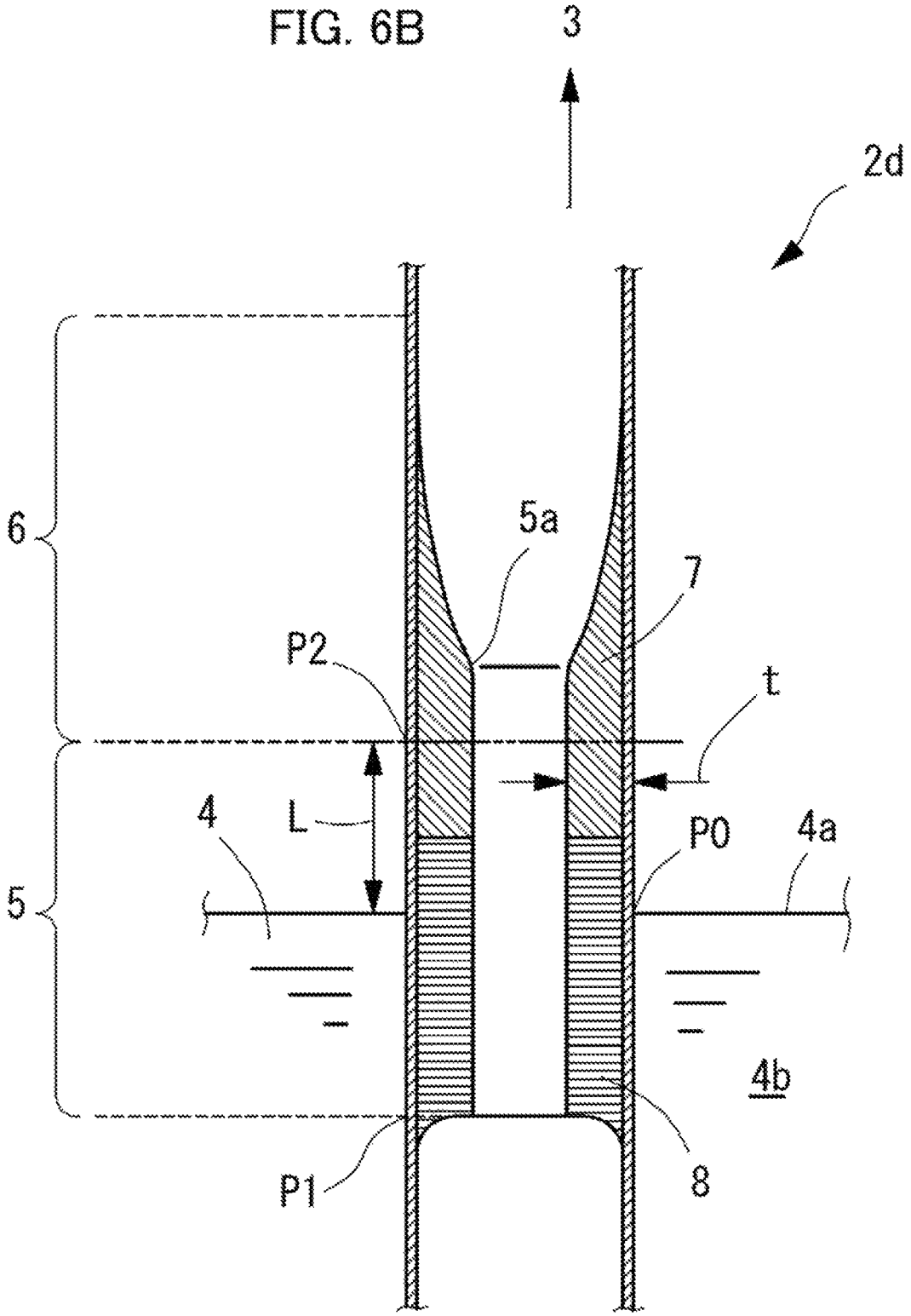

FIG. 6(*a*) is a cross-sectional view illustrating an internal structure of a sign pole 2*c* according to Embodiment 2. In the sign pole 2 of Embodiment 1, the predetermined distance L is 10 mm. Further, the decreasing portion 6 is provided so that the thickness of the sign pole 2 gradually decreases in a curve upward from the second position P2. Further, the sign pole 2 includes the reinforcement portion 5 corresponding to the first range from the first position P1 to the second position P2. The reinforcement portion 5 is formed in a hollow shape having a thickness t of 17.7 mm.

In the sign pole 2*c* of Embodiment 2, the predetermined distance L is 10 mm. Further, the decreasing portion 6 is provided so that the thickness of the sign pole 2*c* gradually decreases upward in a curve from the second position P2. Further, the sign pole 2*c* includes the reinforcement portion 5 corresponding to the first range from the first position P1 to the second position P2. The thickness t of the reinforcement portion 5 is set to 30.25 mm corresponding to the radius of the sign pole 2*c* (the half of the outer diameter). That is, the sign pole 2*c* is solid at the reinforcement portion 5.

Also in the sign pole 2*c* of Embodiment 2, the sign pole 2*c* is formed as one piece along with the reinforcement portion 5 and the decreasing portion 6 similarly to Embodiment 1.

Embodiment 3

FIG. 6(*b*) is a cross-sectional view illustrating an internal structure of a sign pole 2*d* according to Embodiment 3. In the sign pole 2*d* of Embodiment 3, the predetermined distance L is 10 mm. Further, the decreasing portion 6 is provided so that the thickness of the sign pole 2*d* gradually decreases upward in a curve from the second position P2. Further, the sign pole 2*d* includes the reinforcement portion 5 corresponding to the first range from the first position P1 to the second position P2. The reinforcement portion 5 is formed in a hollow shape having a thickness t of 17.7 mm.

In the sign pole 2*d* of Embodiment 3, the reinforcement portion 5 and the decreasing portion 6 are formed separately from the other portion. As illustrated in FIG. 6(*b*), the upper member (the thickness reinforcement member) 7 including a part of the reinforcement portion 5 and the decreasing portion 6 and the lower member 8 including the remaining portion of the reinforcement portion 5 are attached in the hollow portion of the sign pole 2*d*. The same metal material as that of the sign pole 2*d* is preferably used in the upper member 7 and the lower member 8. As a method of fixing the upper member 7 and the lower member 8 in the sign pole 2*d*, for example, press-fitting, welding, thermal caulking, friction-pressure welding, or the like is used. The connection point 5*a* of the upper member 7 is rounded.

Additionally, the outer periphery of the upper member 7 or the lower member 8 and the inner surface of the tube of the sign pole 2*d* are preferably fixed to each other in a non-sliding manner. For example, the outer periphery of the upper member 7 or the lower member 8 and the tube inner surface of the sign pole 2*d* are preferably affixed to each other by an adhesive or welded to each other. Due to the non-sliding fixation, the sliding between the sign pole 2*d* and the upper member 7 or the lower member 8 is prevented when an external bending moment force is applied to the sign pole 2*d*. As a result, the sign pole 2*d* exhibits even higher resistance (strength) to the bending moment force.

Embodiment 4

Figure 7A:
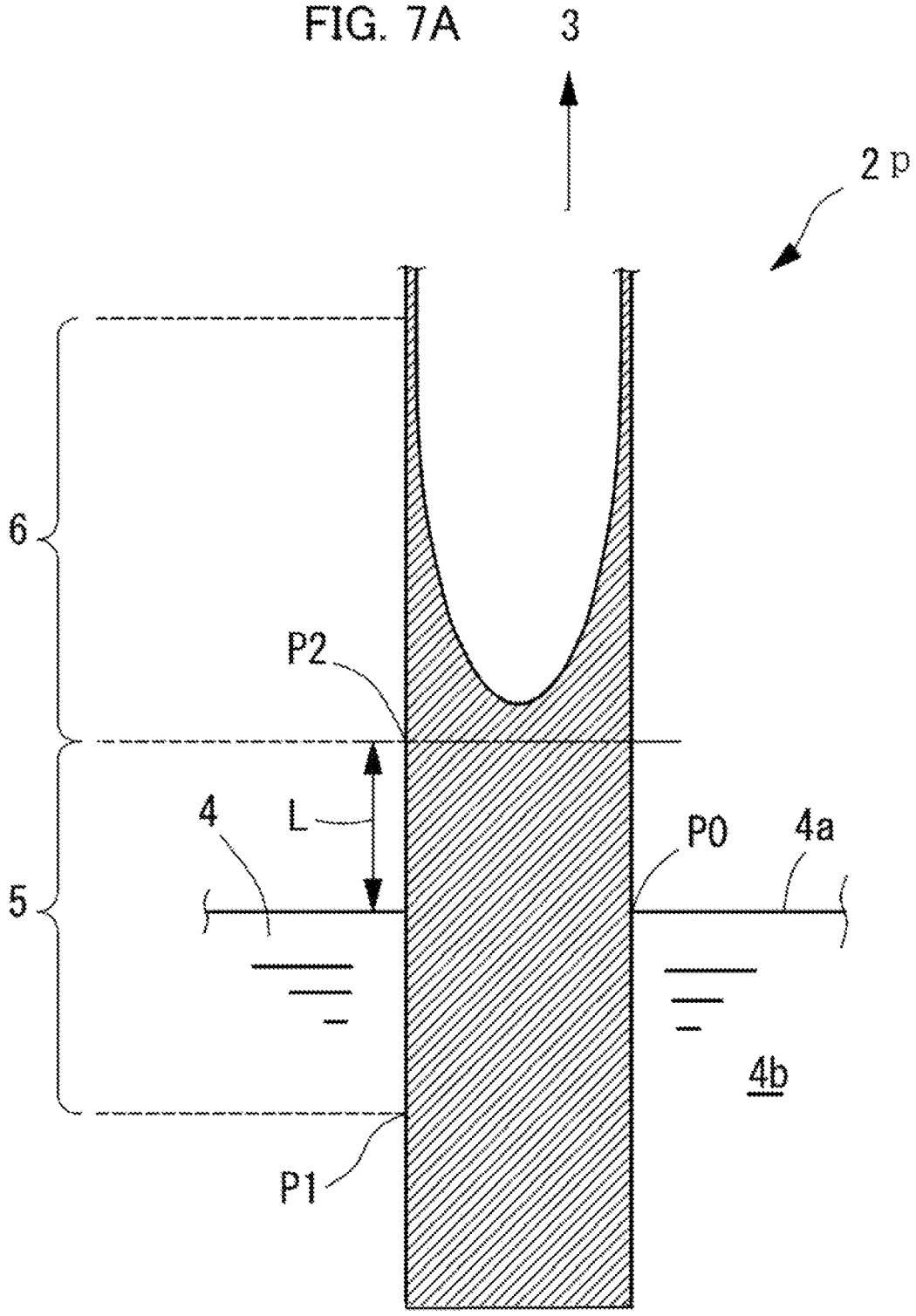
FIG. 7(*a*) is a cross-sectional view illustrating an internal structure of a sign pole according to Embodiment 4 and FIG. 7(*b*) is a cross-sectional view illustrating an internal structure of a sign pole according to Embodiment 5.
Figure 7B:
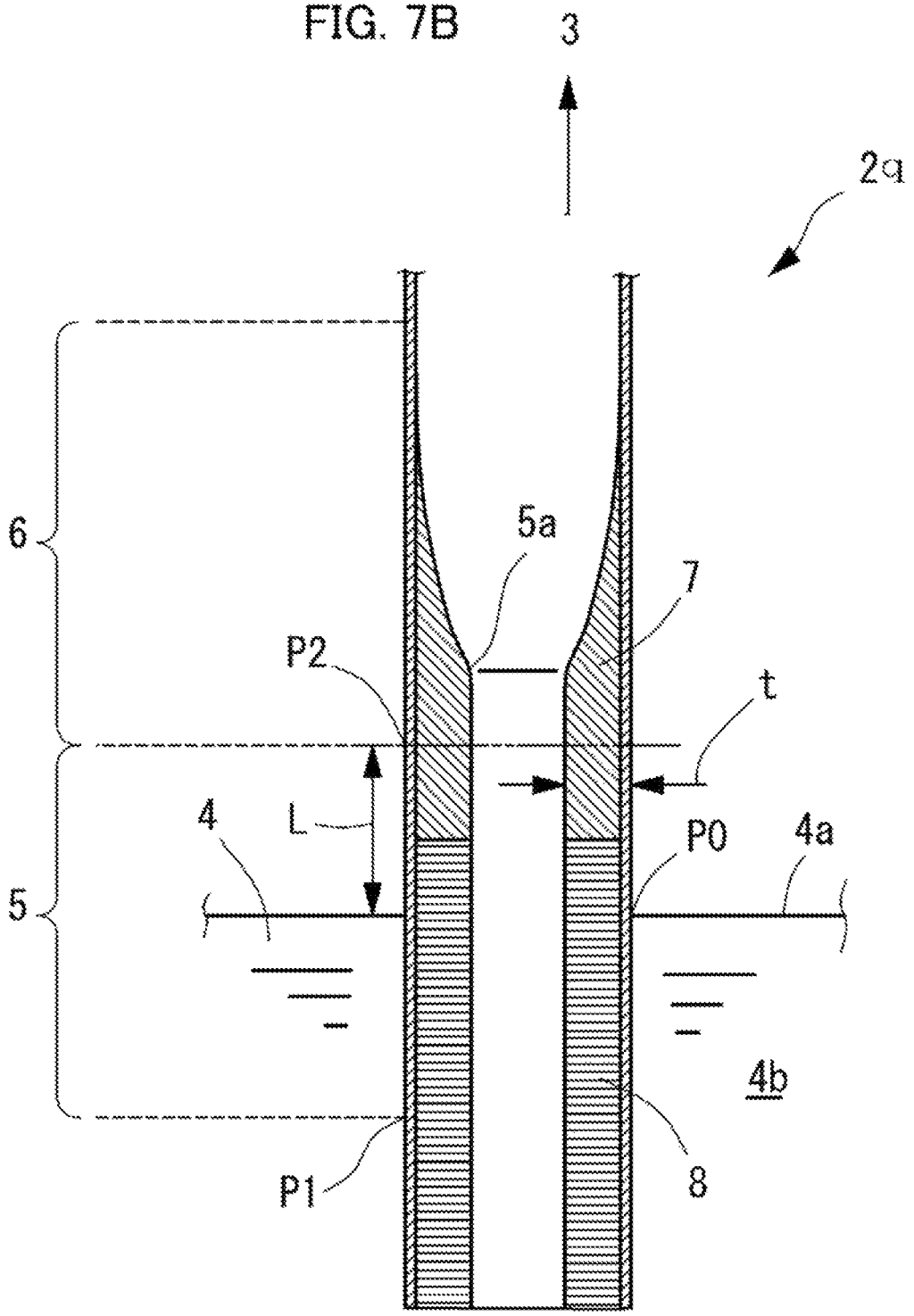

FIG. 7(*a*) is a cross-sectional view illustrating an internal structure of a sign pole 2*p* according to Embodiment 4. In FIG. 7(*a*), the thickness t of the reinforcement portion 5 is set to 30.25 mm corresponding to the radius of the sign pole 2*p* (the half of the outer diameter). That is, the sign pole 2*p* is solid at the reinforcement portion 5. A lower portion from the first position P1 below the ground surface 4*a* is also solid. In the sign pole of the embodiment, since a portion buried in the ground is thick, the sign pole is difficult to be damaged by corrosion and the reliability of the sign pole can be improved.

Embodiment 5

FIG. 7(*b*) is a cross-sectional view illustrating an internal structure of a sign pole 2*q* according to Embodiment 5. The decreasing portion 6 is provided so that the thickness of the sign pole 2*q* gradually decreases upward in a curve from the second position P2. In the sign pole 2*q*, the lower portion from the first position P1 also includes the reinforcement portion 5. The reinforcement portion 5 is hollow to have the thickness t of 17.7 mm. In the sign pole of the embodiment, since a portion buried in the ground is thick, the sign pole is difficult to be damaged by corrosion and the reliability of the sign pole can be improved.

Embodiment 6

Figure 8A:
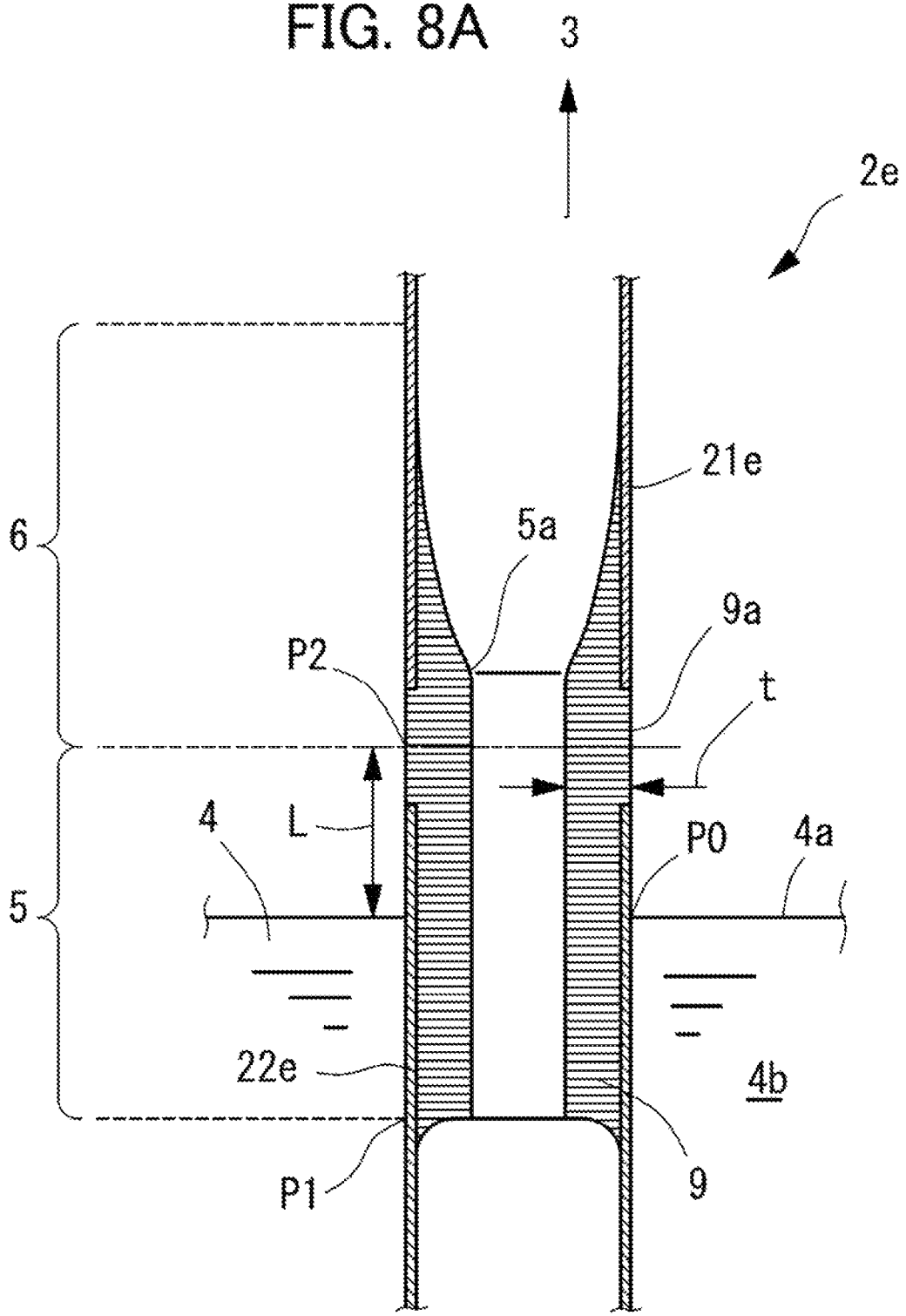
FIG. 8(*a*) is a cross-sectional view illustrating an internal structure of a sign pole according to Embodiment 6 and FIG. 8(*b*) is a cross-sectional view illustrating an internal structure of a sign pole according to Embodiment 7.
Figure 8B:
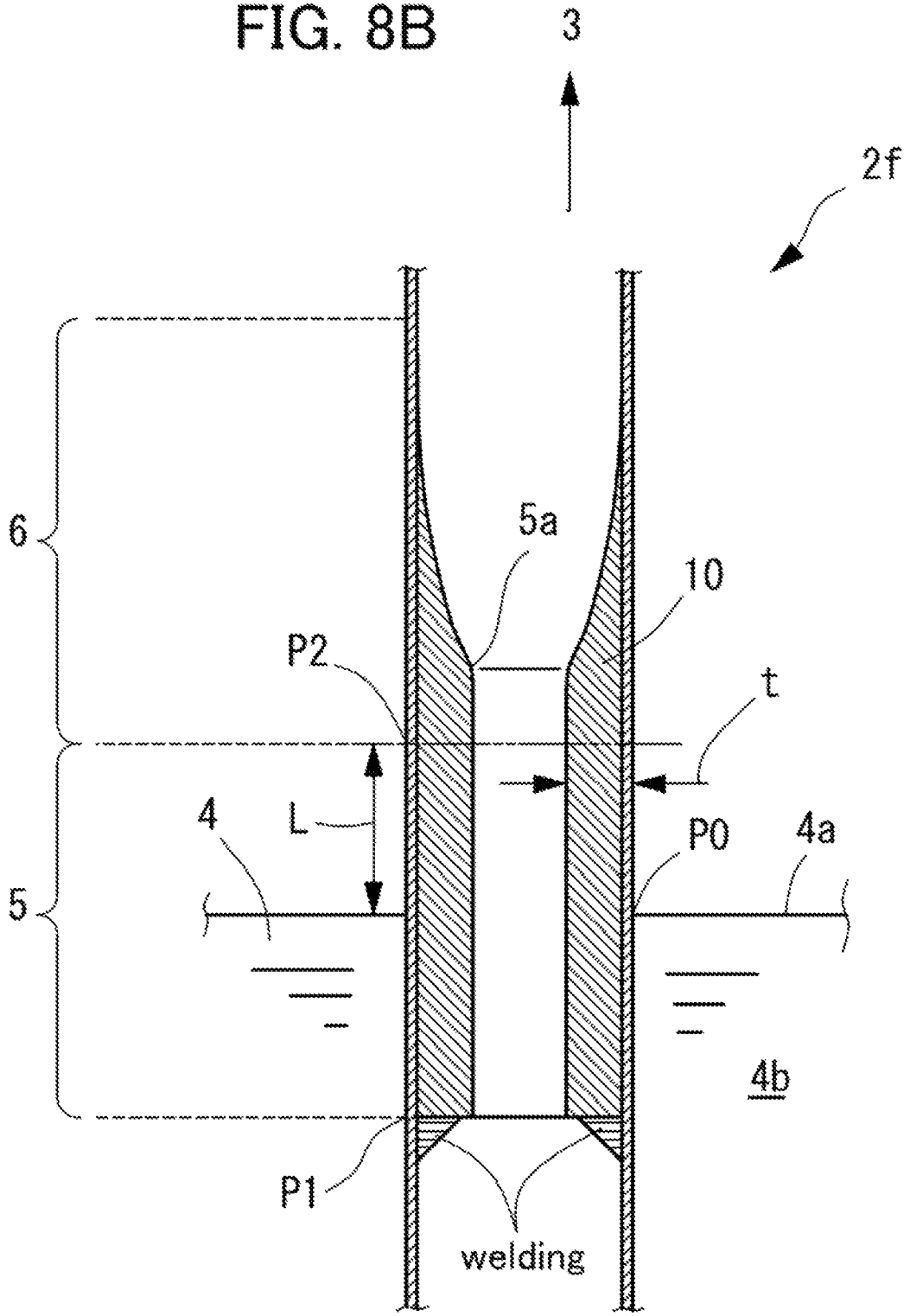

FIG. 8(*a*) is a cross-sectional view illustrating an internal structure of a sign pole 2*e* according to Embodiment 6. In the sign pole 2*e* of Embodiment 6, the predetermined distance L is 10 mm. Further, the decreasing portion 6 is provided so that the thickness of the sign pole 2*e* gradually decreases upward in a curve from the second position P2. Further, the sign pole 2*e* includes the reinforcement portion 5 corresponding to the first range from the first position P1 to the second position P2. The reinforcement portion 5 is formed in a hollow shape having a thickness t of 17.7 mm.

The sign pole 2*e* of Embodiment 6 is formed such that an upper sign pole 21*e* and a lower sign pole 22*e* are respectively inserted into a joint member 9 constituting the reinforcement portion 5 and the decreasing portion 6 from both upper and lower sides. The joint member 9 includes a large diameter portion 9*a* of which an outer diameter partially increases and the upper sign pole 21*e* and the lower sign pole 22*e* are inserted into the joint member 9 so as to abut against the large diameter portion 9*a*.

The second position P2 is preferably a position corresponding to the large diameter portion 9*a*. The sign board 3 is attached to the upper sign pole 21*e*. Further, a part of the lower sign pole 22*e* is embedded in the underground 4*b*. Additionally, the upper sign pole 21*e* and the lower sign pole 22*e* may be fixed to the joint member 9 by, for example, press-fitting, welding, thermal caulking, friction-pressure welding, or the like. The same metal material as that of the sign pole 2*e* is preferably used in the joint member 9. The connection point 5*a* of the joint member 9 is rounded.

Embodiment 7

FIG. 8(*b*) is a cross-sectional view illustrating an internal structure of a sign pole 2*f* according to Embodiment 7. In the sign pole 2*f* of Embodiment 7, the predetermined distance L is 10 mm. Further, the decreasing portion 6 is provided so that the thickness of the sign pole 2*f* gradually decreases upward in a curve from the second position P2. Further, the sign pole 2*d* includes the reinforcement portion 5 corresponding to the first range from the first position P1 to the second position P2. The reinforcement portion 5 is formed in a hollow shape having a thickness t of 17.7 mm.

In the sign pole 2*f* of Embodiment 7, an insertion member (a thickness reinforcement member) 10 constituting the reinforcement portion 5 and the decreasing portion 6 is formed separately from the other portion. The same metal material as that of the sign pole 2*f* is preferably used in the insertion member 10. The insertion member 10 is inserted into the hollow portion of the sign pole 2*f*. The position of the insertion member 10 is adjusted so that the second position P2 is located at a position corresponding to the reinforcement portion 5 and the insertion member is welded and fixed to the hollow inner surface of the sign pole 2*f*. The connection point 5*a* of the insertion member 10 is rounded.

Embodiment 8

Figure 9A:
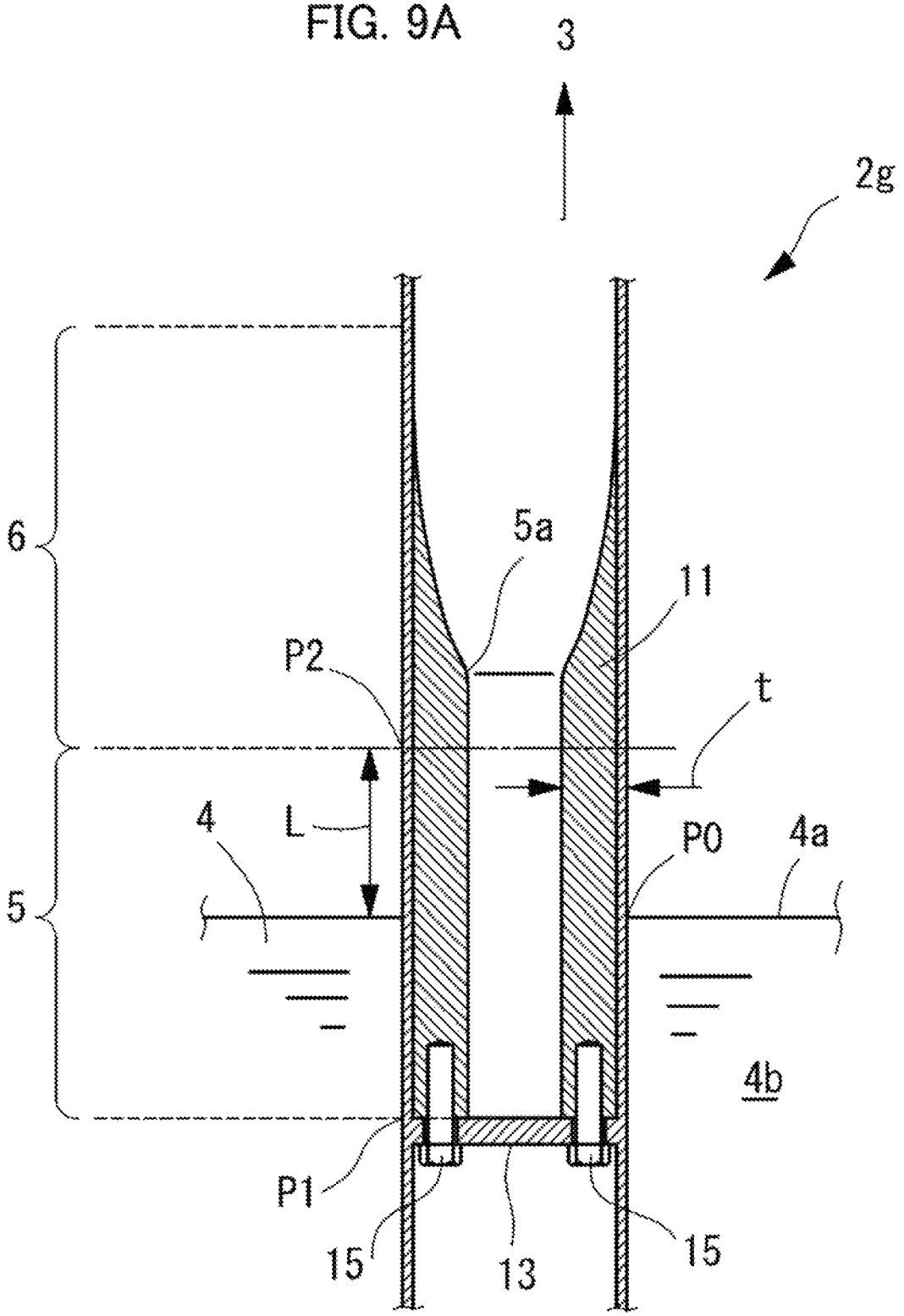
FIG. 9(*a*) is a cross-sectional view illustrating an internal structure of a sign pole according to Embodiment 8 and FIG. 9(*b*) is a cross-sectional view illustrating an internal structure of a sign pole according to Embodiment 9.
Figure 9B:
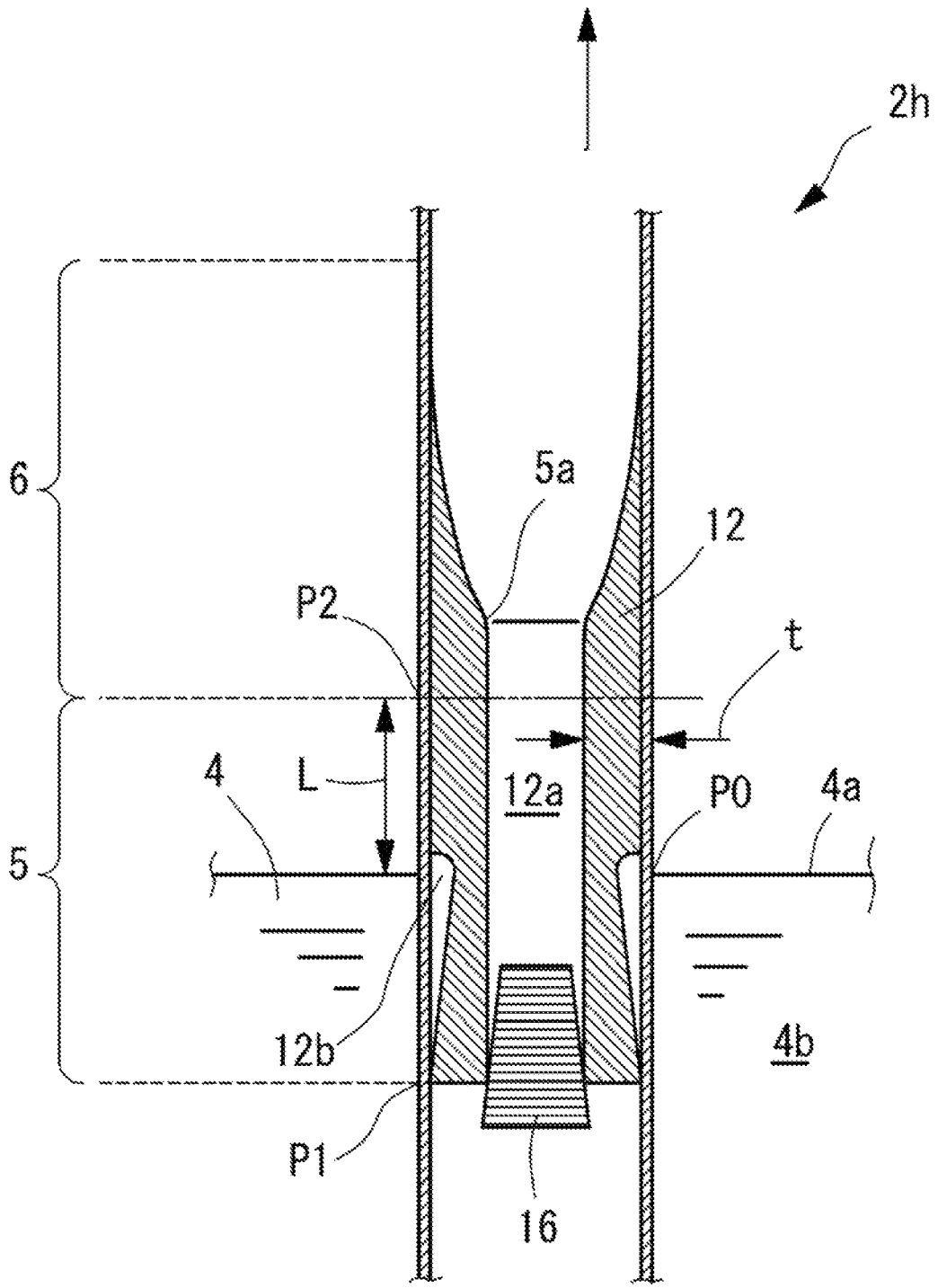

FIG. 9(*a*) is a cross-sectional view illustrating an internal structure of a sign pole 2*g* according to Embodiment 8. In the sign pole 2*g* of Embodiment 8, the predetermined distance L is 10 mm. Further, the decreasing portion 6 is provided so that the thickness of the sign pole 2*g* gradually decreases upward in a curve from the second position P2. Further, the sign pole 2*g* includes the reinforcement portion 5 corresponding to the first range from the first position P1 to the second position P2. The reinforcement portion 5 is formed in a hollow shape having a thickness t of 17.7 mm.

In the sign pole 2*g* of Embodiment 8, an insertion member (a thickness reinforcement member) 11 constituting the reinforcement portion 5 and the decreasing portion 6 is formed separately from the other portion. The same metal material as that of the sign pole 2*g* is preferably used in the insertion member 11. The insertion member 11 is inserted into the hollow portion of the sign pole 2*g*. The position of the insertion member 11 is adjusted so that the second position P2 is located at a position corresponding to the reinforcement portion 5.

A disc portion 13 is formed inside the hollow portion of the sign pole 2*g*. The disc portion 13 is integrated with the outer portion of the sign pole 2*g* and is disposed in a disc shape so as to shield the hollow interior. In other words, the disc portion 13 is a portion having a "bamboo node" shape in the sign pole 2*g*. The disc portion 13 is provided with a through-hole for a fixing screw at a position (two positions in Embodiment 8) corresponding to the insertion member 11. Further, a bottom surface side of the insertion member 11 is provided with a screw hole. When the insertion member 11 is fastened to the disc portion 13 by passing the fixing screw 15 through the through-hole and the screw hole, the insertion member 11 is fixed in the sign pole 2*g*. Accordingly, the reinforcement portion 5 and the decreasing portion 6 are formed. The connection point 5*a* of the insertion member 11 is rounded.

Embodiment 9

FIG. 9(*b*) is a cross-sectional view illustrating an internal structure of a sign pole 2*h* according to Embodiment 9. In the sign pole 2*h* of Embodiment 9, the predetermined distance L is 10 mm. Further, the decreasing portion 6 is provided so that the thickness of the sign pole 2*h* gradually decreases upward in a curve from the second position P2. Further, the sign pole 2*h* includes the reinforcement portion 5 corresponding to the first range from the first position P1 to the second position P2. The reinforcement portion 5 is formed in a hollow shape having a thickness t of 17.7 mm.

In the sign pole 2*h* of Embodiment 9, an insertion member (a thickness reinforcement member) 12 constituting the reinforcement portion 5 and the decreasing portion 6 is formed separately from the other portion. The same metal material as that of the sign pole 2*h* is preferably used in the insertion member 12. The insertion member 12 is inserted into the hollow portion of the sign pole 2*h* and the position is adjusted so that the second position P2 is located at a position corresponding to the reinforcement portion 5.

A wedge member 16 is used to fix the insertion member 12 in the hollow portion of the sign pole 2*h*. The wedge member 16 having a wedge shape is driven into the hollow opening 12*a* formed at the center of the insertion member 12. Accordingly, the insertion member 12 is deformed outward so that the insertion member 12 is pressed against the hollow inner surface of the sign pole 2*h*. As a result, the insertion member 12 is fixed in the hollow portion of the sign pole 2*h*. Due to the outward deformation of the insertion member 12, stress is generated in the sign pole 2*h* outwardly (in the radial direction from the center of the circular cross-section) from the inner surface. This stress further increases the strength of the sign pole 2*h* against the bending moment force. In order to easily deform the insertion member 12, a weak portion 12*b* may be partially formed in the insertion member 12. As illustrated in FIG. 9(*b*), the weak portion 12*b* is a portion in which the thickness of the insertion member 12 is partially thin. Accordingly, the insertion member 12 can be easily deformed outwardly by driving the wedge member 16. The connection point 5*a* of the insertion member 12 is rounded.

Embodiment 10

Figure 10:
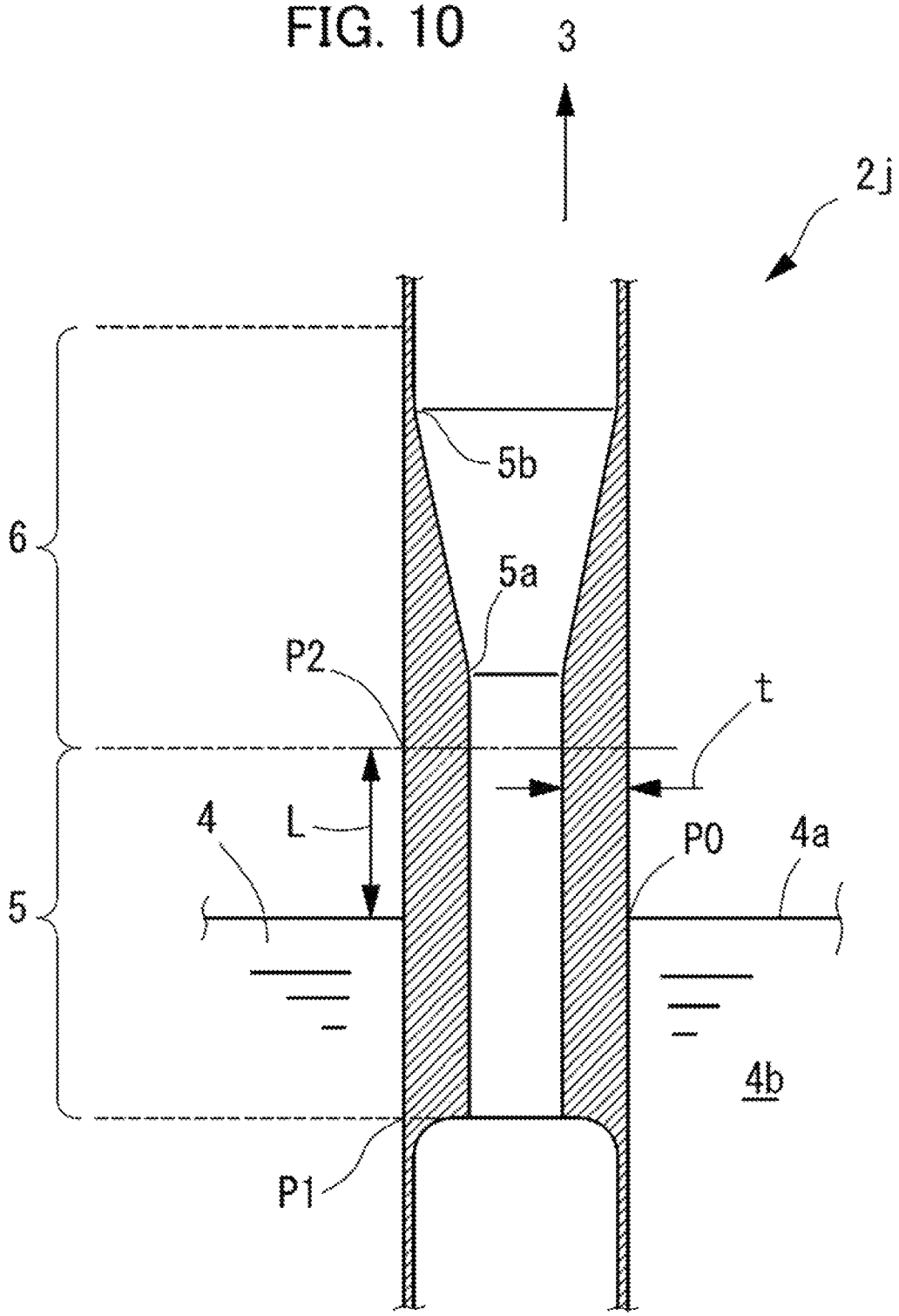
FIG. 10 is a cross-sectional view illustrating an internal structure of a sign pole according to Embodiment 10.

FIG. 10 is a cross-sectional view illustrating an internal structure of a sign pole 2*j* according to Embodiment 10. In the sign pole 2*j* of Embodiment 10, the predetermined distance L is 10 mm. Further, the decreasing portion 6 is provided so that the thickness of the sign pole 2*j* gradually decreases upward linearly from the second position P2. Further, the sign pole 2*j* includes the reinforcement portion 5 corresponding to the first range from the first position P1 to the second position P2. The reinforcement portion 5 is formed in a hollow shape having a thickness t of 17.7 mm.

The sign pole 2*j* of Embodiment 10 has the same configuration as that of the sign pole 2 of Embodiment 1 except that the thickness of the decreasing portion 6 gradually decreases linearly. Also, in the sign pole 2*j*, the reinforcement portion 5 and the decreasing portion 6 are integrally formed with the other portion of the sign pole 2*j*. The connection point 5*a* between the reinforcement portion 5 and the decreasing portion 6 is rounded. Further, a connection point 5*b* which is a terminating portion of the decreasing portion 6 (a portion in which the thickness of the decreasing portion 6 decreases to the same thickness as that of the other portion of the sign pole 2*j*) is also rounded.

Embodiment 11

Figure 11A:
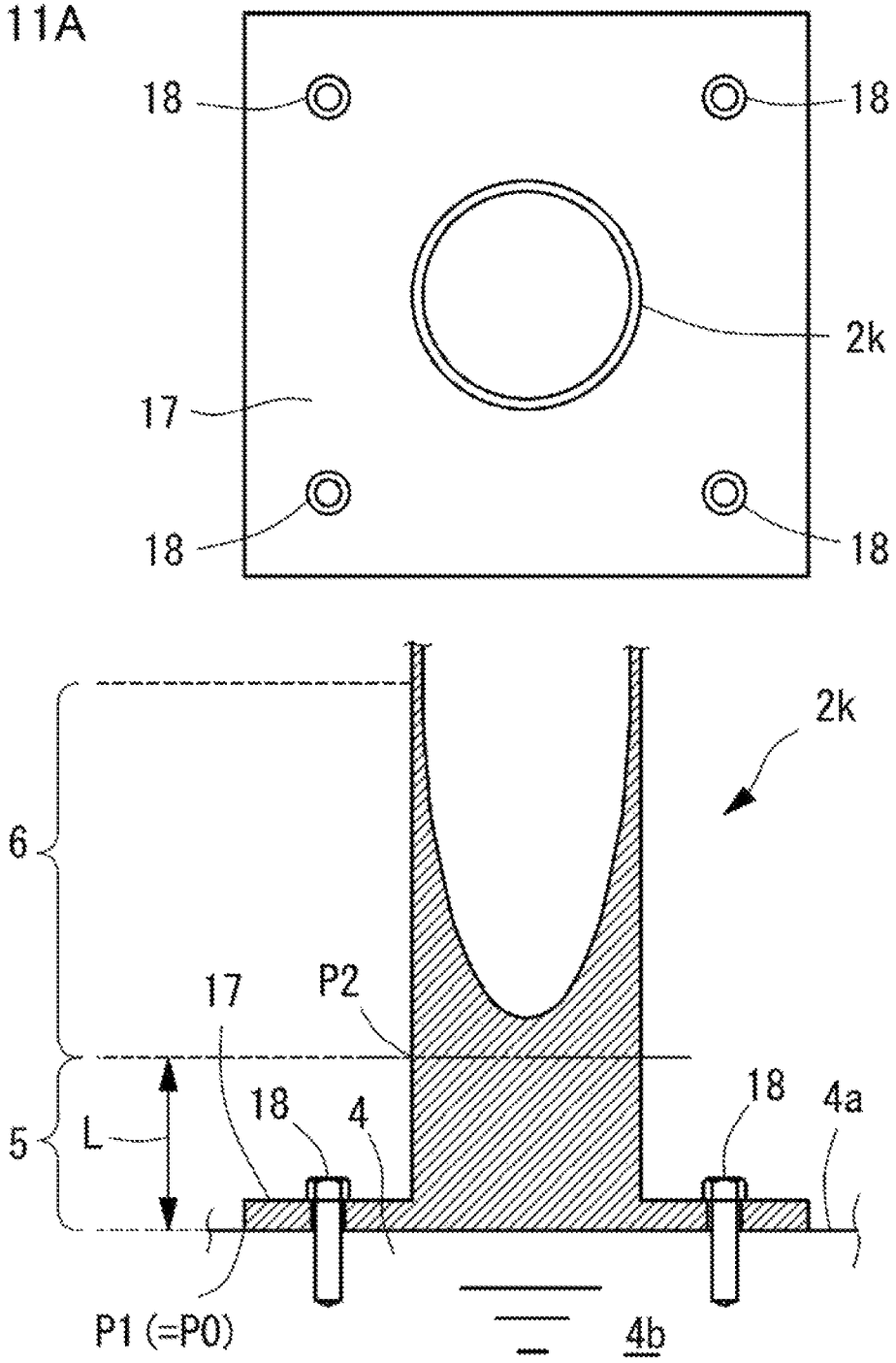
FIG. 11(*a*) is a two-plane view (partially cross-sectional view) illustrating a structure in the vicinity of a ground surface of a civil engineering pillar member according to Embodiment 11 and is a cross-sectional view illustrating an internal structure of a sign pole according to Embodiment 11 and FIG. 11(*b*) is a two-plane view (partially cross-sectional view) illustrating a structure in the vicinity of the ground surface of the civil engineering pillar member according to Embodiment 11.
Figure 11B:
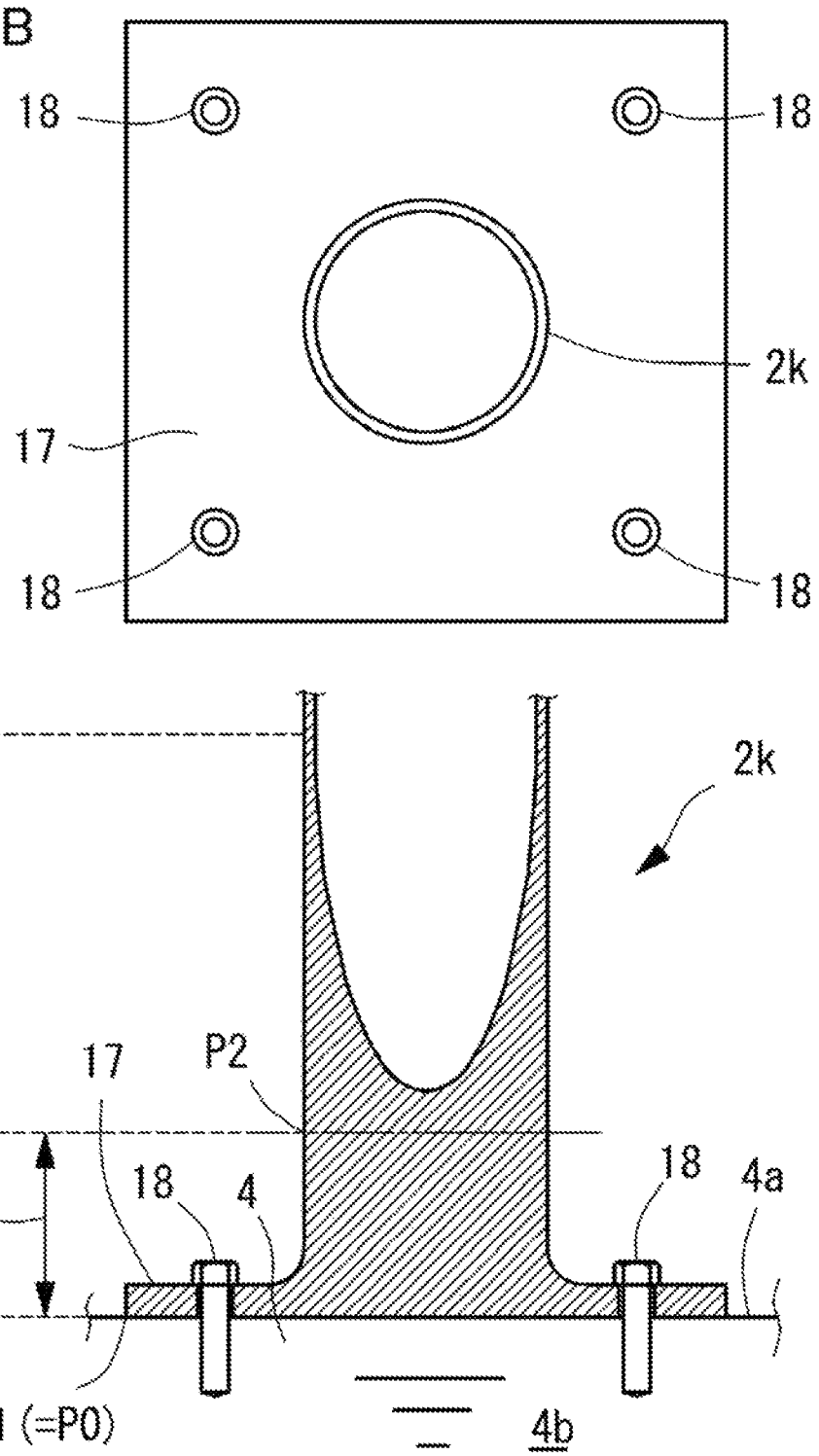

FIG. 11(*a*) is a two-plane diagram (partial cross-sectional view) illustrating a structure in the vicinity of a ground surface 4*a* of a sign pole 2*k* according to Embodiment 11. Here, the sign pole 2*k* can be also applied to a structure of a civil engineering pillar member other than the sign pole. The sign pole 2*k* is not embedded in the underground 4*b* but is planted on the ground 4. Specifically, a flange portion 17 is formed on the outside of the outer periphery of the sign pole 2*k* and the flange portion 17 is fixed to the ground surface 4*a* by an anchor bolt 18.

In the sign pole 2*k*, the predetermined distance L is 10 mm. Further, the decreasing portion 6 is provided so that the thickness of the sign pole 2*k* gradually decreases upward in a curve from the second position P2. Further, the sign pole 2*k* includes the reinforcement portion 5 corresponding to the first range from the first position P1 to the second position P2. For example, as illustrated in FIG. 8(*b*), the reinforcement portion 5 is solid. Additionally, in the sign pole 2*k*, the first position P1 is substantially the same as the level of the ground surface 4*a*. FIG. 11(*b*) illustrates a case in which a connection portion between the outside of the outer periphery of the sign pole 2*k* and the flange portion 17 in FIG. 11(*a*) is processed to have a curved shape. In the sign pole 2*k* illustrated in FIG. 11(*b*), it is possible to prevent stress from concentrating on the connection portion between the outside of the outer periphery of the sign pole 2*k* and the flange portion 17.

Embodiment 12

Figure 12:
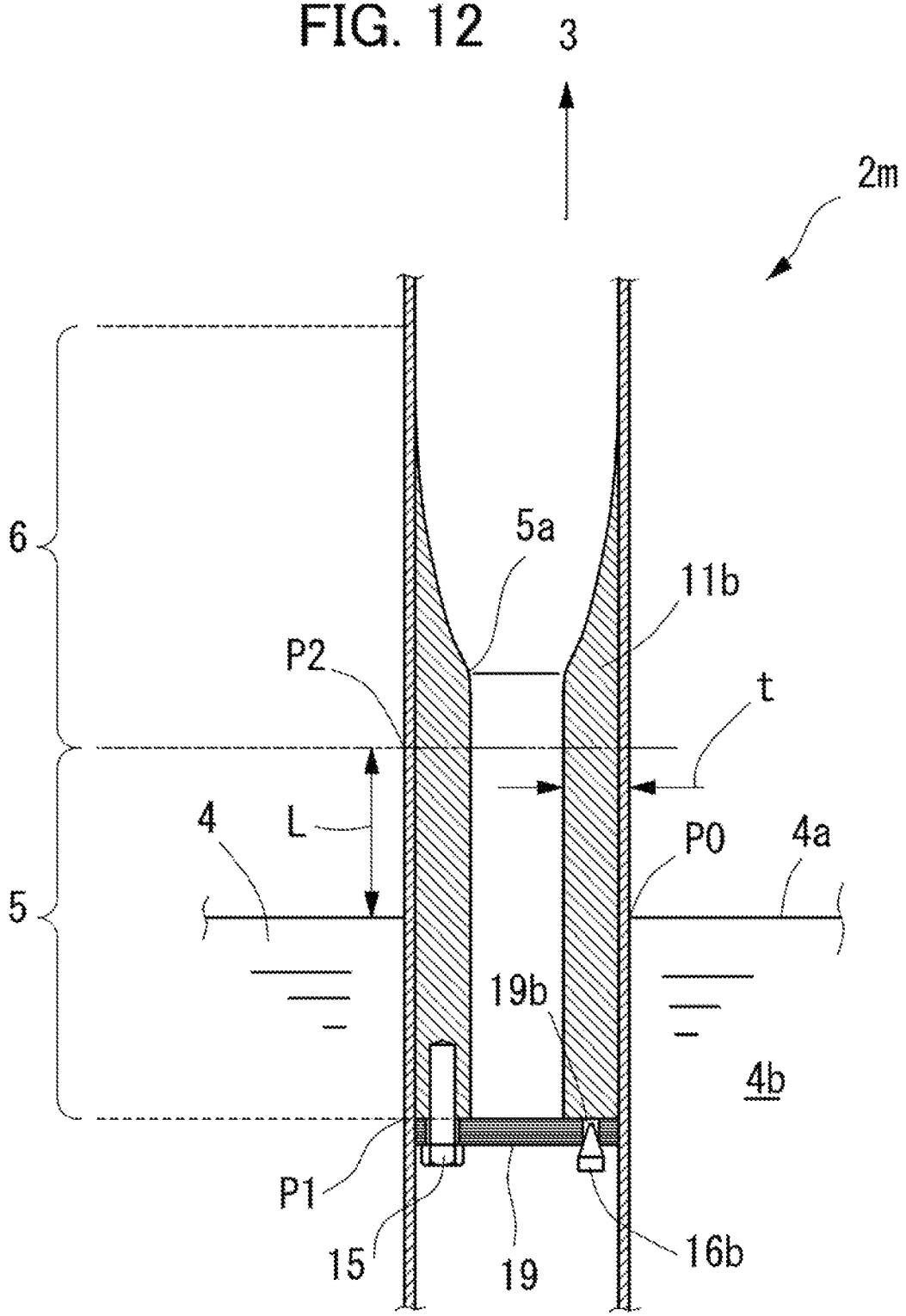
FIG. 12 is a cross-sectional view illustrating an internal structure of a sign pole according to Embodiment 12.

FIG. 12 is a cross-sectional view illustrating an internal structure of a sign pole 2*m* according to Embodiment 12. In the sign pole 2*m* according to Embodiment 12, the predetermined distance L is 10 mm. Further, the decreasing portion 6 is provided so that the thickness of the sign pole 2*m* gradually decreases upward in a curve from the second position P2. Further, the sign pole 2*m* includes the reinforcement portion 5 corresponding to the first range from the first position P1 to the second position P2. The reinforcement portion 5 is formed in a hollow shape having a thickness t of 17.7 mm.

In the sign pole 2*m* of Embodiment 12, an insertion member (a thickness reinforcement member) 11*b* constituting the reinforcement portion 5 and the decreasing portion 6 is formed separately from the other portion. In the insertion member 11*b*, the same metal material as that of the sign pole 2*m* is preferably used. The insertion member 11*b* is inserted into the hollow portion of the sign pole 2*m* and the position is adjusted so that the second position P2 is located at the position corresponding to the reinforcement portion 5.

A flange member 19 formed separately from the sign pole 2*m* is disposed inside the hollow portion of the sign pole 2*m*. The flange member 19 is a disk-shaped member having the same circular shape as that of the inner cross-section of the sign pole 2*m*. Further, the flange member 19 is disposed to shield the inside of the hollow portion of the sign pole 2*m*. A wedge member 16*b* is driven into a through-hole 19*b* formed as an opening in a part of the flange member 19. At this time, the flange member 19 is deformed outward so that the flange member is pressed against the hollow inner surface of the sign pole 2*m*. As a result, the flange member 19 is fixed to the hollow inner surface of the sign pole 2*m*. Due to the outward deformation of the flange member 19, stress is generated in the sign pole 2*m* outward (in the radial direction from the center of the circular cross-section) from the inner surface. This stress further increases the strength of the sign pole 2*m* against the bending moment force.

When the flange member 19 is fixed in the hollow portion of the sign pole 2*m*, the flange member 19 becomes a portion having a so-called "bamboo node" in the sign pole 2*m*. The flange member 19 is provided with a through-hole for a fixing screw at a position (one position in Embodiment 12) corresponding to the insertion member 11*b*. Further, a bottom surface side of the insertion member 11*b* is provided with a screw hole. When the insertion member 11*b* is fastened to the flange member 19 by fixing the screw 15 through the through-hole and the screw hole, the insertion member 11*b* is fixed in the sign pole 2*m*. Accordingly, the reinforcement portion 5 and the decreasing portion 6 are formed. The connection point 5*a* of the insertion member 11*b* is rounded.

As described above, although preferred embodiments of the invention have been described, the invention is not limited to these embodiments and can be modified or changed in various forms within the scope of the gist thereof. For example, the invention includes the following point.

Point 1

A structure of sign pole used in a state embedded in a ground in an upright state includes: a sign pole which is formed by a tubular member having a first outer diameter, a first inner diameter, and a first thickness, the first outer diameter having a substantially constant value. In a state in which the sign pole is embedded in a ground, the sign pole includes a first thick portion having a second thickness larger than the first thickness while maintaining the first outer diameter in a first range from a first position equal to or lower than a level of a ground surface to a second position located above by a predetermined distance from the level of the ground surface.

Point 2

The predetermined distance may be 10 mm or more and the second thickness of the first thick portion may become a maximum thickness at the second position.

Point 3

The sign pole may include a portion that has a thickness gradually decreasing in an upward direction from a thickness of the second position to the first thickness in a position above the second position.

Point 4

The first thick portion may include a thickness reinforcement member inside a tube of the sign pole, the thickness reinforcement member being formed separately from the sign pole formed by the tubular member having the first thickness. Further, the first thick portion may be formed such that the thickness of the sign pole itself changes partially.

Point 5

When the first thick portion is formed such that the thickness reinforcement member formed separately from the sign pole formed by the tubular member having the first thickness is disposed inside the tube of the sign pole, the tubular member includes a tube having an inner surface that is fixed to an outer periphery surface of the thickness reinforcement member in a non-sliding manner.

Point 6

The second thickness of the first thick portion may be substantially the same as the radius of the sign pole at the second position, and the sign pole may be solid.

Point 7

The second thickness of the first thick portion may be larger than the first thickness, and the sign pole preferably has a cross-sectional secondary moment at the first thick portion that is larger than a cross-sectional secondary moment at a portion other than the first thick portion.

Point 8

The first thick portion having the second thickness and/or the portion gradually decreasing in thickness may be provided in at least a part of inside of the tube of the sign pole.

Point 9

The first position of the sign pole may extend to an end portion of the sign pole and the first thick portion having the second thickness may have an end portion that is formed at substantially the same position as the end portion of the sign pole.

Point 10

A structure of sign pole used in a state planted on a ground in an upright state includes: a sign pole which is formed by a tubular member having a first outer diameter, a first inner diameter, and a first thickness, the first outer diameter having a substantially constant value; and a flange portion which is formed outside of an outer periphery of the sign pole. The sign pole includes a first thick portion having a second thickness larger than the first thickness while maintaining the first outer diameter in a first range from a first position near a level of a ground surface to a second position located above by a predetermined distance from the level of the ground surface. In addition, the sign pole includes a portion that has a thickness gradually decreasing in an upward direction from a thickness of the second position to the first thickness in a position above the second position.

Point 11

A sign pole including the structure of sign pole described above.

REFERENCE SIGNS LIST

L: predetermined distance
P0: position
P1: first position
P2: second position
1: road sign
2, 2*a* to 2*h*, 2*j*, 2*m*, 2*p*, 2*q*: sign pole
2*k*: civil engineering pillar member (pillar)
3: sign board
4: ground
4*a*: ground surface
4*b*: underground
5: reinforcement portion (first thick portion)
5*a*, 5*b*: connection point
6: decreasing portion
7: upper member (thickness reinforcement member)
8: lower member
9: joint member
9*a*: large diameter portion
10, 11, 11*b*, 12: insertion member (thickness reinforcement member)
12*a*: hollow opening
12*b*: weak portion
13: disc portion
14: fixing bracket
15: fixing screw
16, 16*b*: wedge member
17: flange portion
18: anchor bolt
19: flange member
19*b*: through-hole
21*e*: upper sign pole
22*e*: lower sign pole

The invention claimed is:

1. A structure of a sign pole used in a state embedded in a ground, comprising:

a sign pole which is formed by a tubular member having a first outer diameter, a first inner diameter, and a first thickness, the first outer diameter having a substantially constant value, wherein in a state in which the sign pole is embedded in the ground, the sign pole includes a first thick portion having a second thickness larger than the first thickness while maintaining the first outer diameter in a first range from a first position equal to or lower than a level of a ground surface to a second position located a predetermined distance above the level of the ground surface, and wherein the sign pole includes a portion that has a thickness gradually decreasing in an upward direction from a thickness of the second position to the first thickness in a position above the second position.

2. The structure of a sign pole according to claim 1, wherein the predetermined distance is 10 mm or more, and wherein the second thickness of the first thick portion becomes a maximum thickness at the second position.

3. The structure of a sign pole according to claim 2, wherein the first thick portion includes a thickness reinforcement member in the sign pole, the thickness reinforcement member being formed separately from the sign pole formed by the tubular member having the first thickness.

4. The structure of a sign pole according to claim 3, wherein the tubular member includes a tube having an inner surface that is fixed to an outer peripheral surface of the thickness reinforcement member in a non-sliding manner.

5. The structure of a sign pole according to claim 2, wherein the second thickness of the first thick portion is substantially the same as the radius of the sign pole at the second position, and the sign pole is solid.

6. The structure of a sign pole according to claim 2, wherein the first position of the sign pole extends to an end portion of the sign pole, and wherein the first thick portion having the second thickness has an end portion that is formed at substantially the same position as the end portion of the sign pole.

7. The structure of a sign pole according to claim 1, wherein the first thick portion includes a thickness reinforcement member in the sign pole, the thickness reinforcement member being formed separately from the sign pole formed by the tubular member having the first thickness.

8. The structure of a sign pole according to claim 7, wherein the tubular member includes a tube having an inner surface that is fixed to an outer peripheral surface of the thickness reinforcement member in a non-sliding manner.

9. The structure of a sign pole according to claim 7, wherein the second thickness of the first thick portion is the substantially same as the radius of the sign pole at the second position, and the sign pole is solid.

10. The structure of a sign pole according to claim 7, wherein the first position of the sign pole extends to an end portion of the sign pole, and wherein the first thick portion having the second thickness has an end portion that is formed at substantially the same position as the end portion of the sign pole.

11. The structure of a sign pole according to claim 1, wherein the second thickness of the first thick portion is substantially the same as the radius of the sign pole at the second position, and the sign pole is solid.

12. The structure of a sign pole according to claim 1, wherein the second thickness of the first thick portion is larger than the first thickness, and the sign pole has a cross-sectional secondary moment at the first thick portion that is larger than a cross-sectional secondary moment at a portion other than the first thick portion.

13. The structure of a sign pole according to claim 1, wherein the first thick portion having the second thickness and/or the portion gradually decreasing in thickness is provided in at least a part in the sign pole.

14. The structure of a sign pole according to claim 1, wherein the first position of the sign pole extends to an end portion of the sign pole, and wherein the first thick portion having the second thickness has an end portion that is formed at substantially the same position as the end portion of the sign pole.

15. A sign pole comprising:

the structure of a sign pole according to claim 1.

* * * * *